US011543174B2

(12) United States Patent
Choi

(10) Patent No.: US 11,543,174 B2
(45) Date of Patent: Jan. 3, 2023

(54) REFRIGERATOR

(71) Applicant: LG ELECTRONICS INC., Seoul (KR)

(72) Inventor: Seonwoo Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 367 days.

(21) Appl. No.: 16/582,756

(22) Filed: Sep. 25, 2019

(65) Prior Publication Data

US 2021/0010747 A1 Jan. 14, 2021

(30) Foreign Application Priority Data

Jul. 12, 2019 (KR) ..... 10-2019-0084449

(51) Int. Cl.

| | |
|---|---|
| ***F25D 25/02*** | (2006.01) |
| ***F25D 23/02*** | (2006.01) |
| ***F25D 25/00*** | (2006.01) |
| ***A47B 88/457*** | (2017.01) |
| ***A47B 88/90*** | (2017.01) |

(52) U.S. Cl.

CPC ..... *F25D 25/005* (2013.01); *A47B 88/457* (2017.01); *A47B 88/90* (2017.01); *F25D 25/025* (2013.01); *A47B 2088/901* (2017.01); *A47B 2210/175* (2013.01); *F25D 2325/021* (2013.01)

(58) Field of Classification Search

CPC ..... F25D 25/005; F25D 25/025; F25D 23/02; F25D 2325/021; A47B 88/90; A47B 88/457; A47B 2088/901; A47B 2210/175

See application file for complete search history.

(56) References Cited

U.S. PATENT DOCUMENTS

| | | | | |
|---|---|---|---|---|
| 658,999 A | | 10/1900 | Scannel | |
| 1,067,404 A | * | 7/1913 | Callaghan ..... | A47B 88/493 312/331 |
| 2,072,244 A | | 3/1937 | Coursen | |
| 2,679,658 A | | 6/1954 | McCormick | |
| 2,731,318 A | | 1/1956 | Hoff | |

(Continued)

FOREIGN PATENT DOCUMENTS

| | | |
|---|---|---|
| CN | 100417900 | 9/2008 |
| CN | 101981397 | 2/2011 |

(Continued)

OTHER PUBLICATIONS

European Search Report dated Mar. 12, 2020 issued in EP Application No. 19199586.9.

(Continued)

*Primary Examiner* — Kimberley S Wright
(74) *Attorney, Agent, or Firm* — Ked & Associates, LLP

(57) ABSTRACT

A refrigerator includes a rack gear assembly provided on a lower surface of a drawer, wherein the rack gear assembly has a first rack member and a second rack member sequentially moved forward such that an opening distance of the drawer is maximized, and a wing end of the second rack member and a blocking part of a bottom of a storage chamber are provided such that exact engagement of a rack gear with a pinion is maintained during opening of the drawer. In addition, while the drawer is opened, an unwanted movement of the drawer in a closing direction thereof is prevented.

19 Claims, 31 Drawing Sheets

(56) References Cited

U.S. PATENT DOCUMENTS 4,545,628 A 10/1985 Richey
5,253,488 A 10/1993 Kim et al.
6,044,606 A 4/2000 Hamar
6,109,774 A 8/2000 Holmes et al.
6,371,584 B1 4/2002 Alreck
6,722,749 B1 4/2004 Pagac
7,600,829 B2 10/2009 Oh et al.
7,600,830 B2 10/2009 Oh et al.
7,600,833 B2 * 10/2009 Oh ..... F25D 25/025 312/404
7,690,586 B2 4/2010 Kang
8,282,177 B1 * 10/2012 Rotter ..... F25D 25/025 312/402
8,360,539 B2 * 1/2013 Brown ..... F25D 25/025 312/402
8,376,481 B2 2/2013 Lee
8,497,644 B2 7/2013 Eom et al.
8,668,289 B2 3/2014 Lee et al.
8,794,722 B2 8/2014 Nuss et al.
8,844,110 B2 * 9/2014 Rotter ..... F25D 25/025 29/434
8,864,249 B2 10/2014 Nam et al.
9,107,494 B2 8/2015 Scheuring et al.
9,377,238 B2 6/2016 Hall et al.
9,523,533 B2 12/2016 Nam et al.
9,982,937 B2 5/2018 Tierney et al.
10,234,195 B2 3/2019 Yasaka et al.
10,465,970 B1 * 11/2019 Kang ..... F25D 25/025
10,598,428 B2 3/2020 Kim
10,690,401 B2 6/2020 Yang et al.
10,712,083 B1 * 7/2020 Choi ..... A47B 88/90
10,767,920 B1 * 9/2020 Choi ..... F25D 23/067
10,786,080 B1 9/2020 Stravitz et al.
10,876,788 B2 * 12/2020 Choi ..... F25D 23/028
10,932,568 B2 3/2021 Subrahmanya et al.
10,939,758 B2 3/2021 Kim
11,033,104 B2 * 6/2021 Kim ..... A47B 88/423
11,047,619 B2 * 6/2021 Choi ..... F25D 23/04
11,131,500 B2 * 9/2021 Kim ..... F25D 17/065
2003/0201700 A1 10/2003 Cho
2004/0031705 A1 2/2004 Detemple, II et al.
2004/0046488 A1 3/2004 Hogan
2004/0056573 A1 3/2004 Chae
2006/0042306 A1 3/2006 Choi et al.
2006/0087207 A1 4/2006 Oh et al.
2006/0087208 A1 4/2006 Oh et al.
2006/0207283 A1 9/2006 Kim et al.
2006/0248916 A1 11/2006 Kim et al.
2006/0250062 A1 11/2006 Janda et al.
2007/0262686 A1 11/2007 Ji
2008/0018215 A1 1/2008 Carden et al.
2009/0045713 A1 2/2009 Kunkle et al.
2009/0160298 A1 6/2009 Chen et al.
2009/0167131 A1 * 7/2009 Oh ..... F25D 25/025 312/405
2009/0277210 A1 11/2009 Eveland et al.
2010/0192621 A1 8/2010 Kim
2010/0236279 A1 * 9/2010 Eom ..... F25D 25/025 62/449
2010/0239795 A1 9/2010 Gat
2010/0283365 A1 11/2010 Chen
2011/0005264 A1 1/2011 Lee et al.
2011/0006656 A1 1/2011 Nam et al.
2011/0050065 A1 3/2011 Lee et al.
2011/0050066 A1 3/2011 Lee et al.
2011/0146333 A1 6/2011 Koo et al.
2011/0162402 A1 7/2011 Park
2011/0181163 A1 7/2011 Han et al.
2011/0210655 A1 * 9/2011 Brown ..... A47B 88/40 312/334.8
2012/0091872 A1 4/2012 Matthes et al.
2012/0125035 A1 5/2012 Chellappan et al.
2012/0306338 A1 12/2012 Nagahata et al.
2013/0055543 A1 * 3/2013 Rotter ..... A47B 88/467 29/428
2013/0129267 A1 5/2013 Chen
2013/0145972 A1 6/2013 Knox et al.
2013/0264928 A1 10/2013 Hong et al.
2013/0270986 A1 10/2013 Min et al.
2013/0270987 A1 10/2013 Kelly
2013/0270989 A1 10/2013 Park et al.
2014/0191646 A1 7/2014 Nuss et al.
2014/0265783 A1 9/2014 Hauer et al.
2014/0265797 A1 * 9/2014 Scheuring ..... A47B 51/00 312/404
2014/0265806 A1 9/2014 Hall et al.
2014/0319990 A1 10/2014 Gephart et al.
2015/0059398 A1 3/2015 Yoo et al.
2015/0059399 A1 3/2015 Hwang et al.
2015/0069899 A1 3/2015 Han et al.
2015/0184918 A1 7/2015 Klingshirn et al.
2016/0146533 A1 5/2016 Jung
2016/0153704 A1 6/2016 Burke et al.
2016/0178274 A1 6/2016 Shin
2016/0265816 A1 9/2016 Gillette et al.
2016/0305705 A1 10/2016 Dubina et al.
2016/0320118 A1 11/2016 Millett
2016/0370063 A1 12/2016 Yang
2017/0024946 A1 1/2017 Hashemi et al.
2017/0051967 A1 2/2017 Tierney et al.
2017/0122651 A1 5/2017 Cizik et al.
2017/0227279 A1 8/2017 Yang et al.
2017/0336129 A1 11/2017 Cunningham
2017/0362864 A1 12/2017 Fazi et al.
2018/0128540 A1 5/2018 Yasaka et al.
2018/0283771 A1 10/2018 Shin et al.
2018/0291669 A1 10/2018 Kim et al.
2018/0356148 A1 12/2018 Fei et al.
2019/0219324 A1 7/2019 Kang
2019/0242640 A1 * 8/2019 Minoru ..... F25D 23/067
2019/0292831 A1 9/2019 Choi
2019/0293341 A1 9/2019 Yeom
2019/0323763 A1 10/2019 Kang
2019/0346199 A1 * 11/2019 Choi ..... F25D 23/028
2019/0390895 A1 12/2019 Choi
2020/0011593 A1 1/2020 Ji
2020/0069056 A1 * 3/2020 Kim ..... A47B 88/423
2020/0072533 A1 3/2020 Cho
2020/0072540 A1 * 3/2020 Kim ..... F25D 25/021
2020/0072542 A1 * 3/2020 Kim ..... F25D 23/021
2021/0003337 A1 1/2021 Voltarelli et al.
2021/0259416 A1 * 8/2021 Kim ..... A47B 88/453

FOREIGN PATENT DOCUMENTS

CN 102226626 10/2011
CN 202254607 5/2012
CN 202970226 6/2013
CN 204902419 12/2015
CN 107388718 11/2017
CN 108645104 10/2018
CN 109028726 12/2018
CN 208640001 3/2019
CN 109690213 4/2019
CN 208736030 4/2019
CN 109838961 6/2019
CN 109990557 7/2019
CN 110873500 3/2020
DE 29620152 4/1997
DE 10 2005 016 418 11/2005
EP 1 724 540 11/2006
EP 2 299 215 3/2011
EP 2 752 632 7/2014
EP 3 023 721 5/2016
EP 3 505 854 7/2019
EP 3 546 862 10/2019
EP 3 617 630 3/2020
GB 2108564 5/1983
JP H04-138337 12/1992
JP H07-275049 10/1995
JP H08-303944 11/1996
JP 2001-280824 10/2001

(56) References Cited

FOREIGN PATENT DOCUMENTS

| | | |
|---|---|---|
| JP | 2002-264943 | 9/2002 |
| KR | 10-2006-0025806 | 3/2006 |
| KR | 10-2006-0027592 | 3/2006 |
| KR | 10-2006-0053420 | 5/2006 |
| KR | 10-2007-0075671 | 7/2007 |
| KR | 10-2008-0101335 | 11/2008 |
| KR | 10-2009-0027111 | 3/2009 |
| KR | 10-2009-0027112 | 3/2009 |
| KR | 10-2009-0102576 | 9/2009 |
| KR | 10-2009-0102577 | 9/2009 |
| KR | 10-0921380 | 10/2009 |
| KR | 10-2009-0114265 | 11/2009 |
| KR | 10-2010-0012544 | 2/2010 |
| KR | 10-0946784 | 3/2010 |
| KR | 10-2010-0078916 | 7/2010 |
| KR | 10-2011-0015331 | 2/2011 |
| KR | 20-0460442 | 6/2012 |
| KR | 10-2013-0071919 | 7/2013 |
| KR | 10-2014-0037474 | 3/2014 |
| KR | 10-2018-0138083 | 12/2018 |
| KR | 10-2018-0138085 | 12/2018 |
| KR | 10-2019-0081331 | 7/2019 |
| WO | 92/14522 | 9/1992 |
| WO | WO 03/016661 | 2/2003 |
| WO | WO 2018/051963 | 3/2018 |
| WO | WO 2019/242234 | 12/2019 |

OTHER PUBLICATIONS

European Search Report dated Mar. 17, 2020 issued in EP Application No. 19199553.9.
European Search Report dated Mar. 20, 2020 issued in EP Application No. 19199569.5.
European Search Report dated Mar. 30, 2020 issued in EP Application No. 19199556.2.
European Search Report dated Apr. 3, 2020 issued in EP Application No. 19199625.5.
European Search Report dated Apr. 6, 2020 issued in EP Application No. 19199629.7.
European Search Report dated Apr. 6, 2020 issued in EP Application No. 19199587.7.
European Search Report dated Apr. 7, 2020 issued in EP Application No. 19199607.3.
Chinese Office Action dated Sep. 3, 2021 issued in CN Application No. 201910905106.9.
European Communication dated Feb. 8, 2021 issued in Application No. 19199627.1.
European Search Report dated Mar. 23, 2020 issued in EP Application No. 19199602.4.
United States Office Action dated Mar. 4, 2020 issued in U.S. Appl. No. 16/582,712.
United States Office Action dated Mar. 9, 2020 issued in U.S. Appl. No. 16/582,810.
European Search Report dated Aug. 14, 2020 issued in EP Application No. 19199647.9.
United States Office Action dated Nov. 19, 2020 issued in U.S. Appl. No. 16/582,831.
European Office Action dated Sep. 1, 2021 issued in EP Application No. 19199607.3.
European Office Action dated Sep. 30, 2020 issued in EP Application No. 19199556.2.
European Search Report dated Apr. 1, 2020 issued in EP Application No. 19199637.0.
Chinese Office Action dated Aug. 20, 2021 issued in CN Application No. 201910857469.X.
Chinese Office Action dated Aug. 25, 2021 issued in CN Application No. 201910911807.3.
Chinese Office Action dated Sep. 2, 2021 issued in CN Application No. 201910871084.9.
Chinese Office Action dated Sep. 17, 2021 issued in CN Application No. 201910905094.X.
United States Office Action dated Oct. 6, 2021 issued in co-pending related U.S. Appl. No. 16/583,726.
United States Office Action dated Oct. 6, 2021 issued in co-pending related U.S. Appl. No. 16/582,647.
United States Office Action dated Oct. 6, 2021 issued in co-pending related U.S. Appl. No. 16/582,668.
Chinese Office Action dated Aug. 24, 2021 issued in CN Application No. 201910911796.9.
Chinese Office Action dated Sep. 8, 2021 issued in CN Application No. 201910857458.1.
Chinese Office Action dated Sep. 14, 2021 issued in CN Application No. 201910905166.0.
United States Office Action dated Oct. 15, 2021 issued in co-pending related U.S. Appl. No. 16/582,755.
United States Notice of Allowance dated Feb. 23, 2022 issued in co-pending related U.S. Appl. No. 16/582,518.
United States Notice of Allowance dated Feb. 23, 2022 issued in co-pending related U.S. Appl. No. 16/585,284.
United States Office Action dated Feb. 2, 2022 issued in co-pending related U.S. Appl. No. 16/582,605.
Chinese Office Action dated May 16, 2022 issued in CN Application No. 201910905106.9.
GE (Refrigerator Freezer Door Pops Open, http://products.geapplicances.com/appliance/gea-support-search-content?contentId=16979) (Year: 2015).
United States Office Action dated Apr. 11, 2022 issued in co-pending related U.S. Appl. No. 16/585,301.
U.S. Appl. No. 16/583,726, filed Sep. 26, 2019.
U.S. Appl. No. 16/582,647, filed Sep. 25, 2019.
U.S. Appl. No. 16/582,518, filed Sep. 25, 2019.
U.S. Appl. No. 16/582,605, filed Sep. 25, 2019.
U.S. Appl. No. 16/585,284, filed Sep. 27, 2019.
U.S. Appl. No. 16/582,831, filed Sep. 25, 2019.
U.S. Appl. No. 16/582,712, filed Sep. 25, 2019.
U.S. Appl. No. 16/582,810, filed Sep. 25, 2019.
U.S. Appl. No. 16/582,756, filed Sep. 25, 2019.
U.S. Appl. No. 16/582,668, filed Sep. 25, 2019.
U.S. Appl. No. 16/582,755, filed Sep. 25, 2019.
U.S. Appl. No. 17/880,665, filed Aug. 4, 2022.
U.S. Appl. No. 17/830,750, filed Jun. 2, 2022.
U.S. Appl. No. 16/585,301, filed Sep. 27, 2019.
U.S. Appl. No. 16/585,816, filed Sep. 27, 2019.

* cited by examiner

REFRIGERATOR

CROSS-REFERENCE TO RELATED APPLICATION(S)

The present application claims priority to Korean Patent Application No. 10-2019-0084449, filed in Korea on Jul. 12, 2019, the entire contents of which is incorporated herein for all purposes by this reference.

BACKGROUND

1. Field

The present disclosure relates to a refrigerator having a drawer.

2. Background

A refrigerator is an appliance that includes a cabinet defining an interior storage chamber that is maintained at a relatively cool temperature. For example, the refrigerator may generate cold air to cool the storage chamber by circulation of a refrigerant according to a refrigeration cycle.

The refrigerator may include various types of mechanisms that provide access to the storage chamber via an opening in the cabinet and seal the opening. For example, the refrigerator may include a swinging door and/or a sliding drawer. A hybrid-type refrigerator may include both a door and a drawer. The hybrid-type refrigerator may include, for example, at least one swinging door positioned at an upper portion of the cabinet and a drawer positioned at a lower portion of the cabinet.

The drawer may include a front panel and a storage bin. The front panel may form a portion of a front surface of the refrigerator and may provide a handling surface to receive a user-applied force to slide the drawer in or out of an interior of the cabinet. The storage bin may be provided at a rear of the front panel to be selectively inserted into or removed from the interior of the cabinet based on the user-applied force to the front panel.

A refrigerator may include a drawer that automatically opens or closes. For example, as described in Korean Patent Application Publication Nos. 10-2009-0102577, 10-2009-0102576, 10-2013-0071919, and 10-2018-0138083, a combination of rack and a pinion may be used to automatically apply a force to move a drawer. For example, a guide rack having a rack gear may be provided on opposite inner side wall surfaces of the cabinet, and a pinion may be provided on opposite side wall surfaces or opposite sides of a rear surface of the storage bin to engage the guide racks.

However, an opening distance of the drawer may be limited due an engagement between the rack and the pinion such that user access to an interior of the storage bin is restricted. Furthermore, one or more walls of the storage bin may be deformed due to a weight of items stored in the storage bin, and this deformation of the storage bin may move a guide rack relative to a pinion such that the pinion may run idly or gear teeth of the pinion and the guide rack do not engage correctly and collide. In addition, a user may apply an incidental force to the open drawer when accessing the storage bin, and this force may cause the drawer to accidently close.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
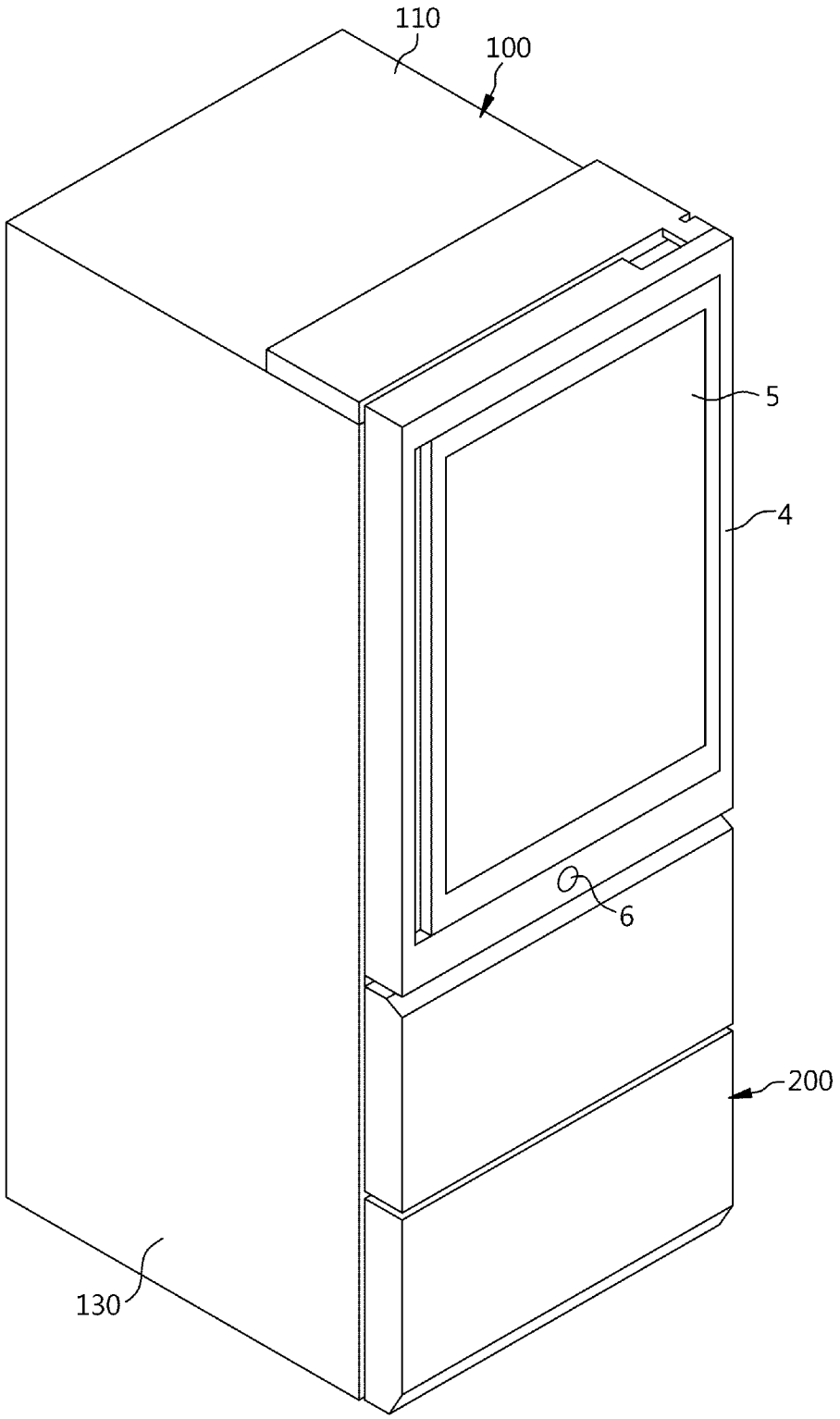
FIG. 1 is a perspective view illustrating the refrigerator according to an embodiment of the present disclosure.

Hereinbelow, a refrigerator is described with reference to FIGS. 1 to 32. As illustrated in the drawings, a refrigerator according to certain embodiments of the present disclosure may include a cabinet 100, a drawer 200, a driving part (or driving module) 400, and one or more rack gear assemblies 600. In certain examples, the rack gear assemblies 600 may extend in multiple steps such that the drawer 200 may be completely moved forward out of a lower storage chamber 3 in the cabinet 100.

The cabinet 100 may constitute an outer surface of the refrigerator. The cabinet 100 may include an upper wall or roof 110, a lower wall or bottom 120 constituting, and opposite side walls 130. For example, the cabinet may be configured as a box body, which is opened forward. An inner space of the cabinet 100 may provide a storage space.

In addition, one or more partition walls 140 may be provided in the cabinet 100. The partition walls 140 may be divide the storage space of an inner part of the cabinet 100 into a two or more spaces. In certain implementations, the partition walls 140 may extend vertically to partition the storage space in the cabinet 100 to form, for example, a plurality of storage chambers 1, 2, and 3, which are vertically positioned. In other implementations, the partition walls 140 may extend vertically to partition the storage space in the cabinet 100 into storage chambers that are horizontally positioned.

Figure 2:
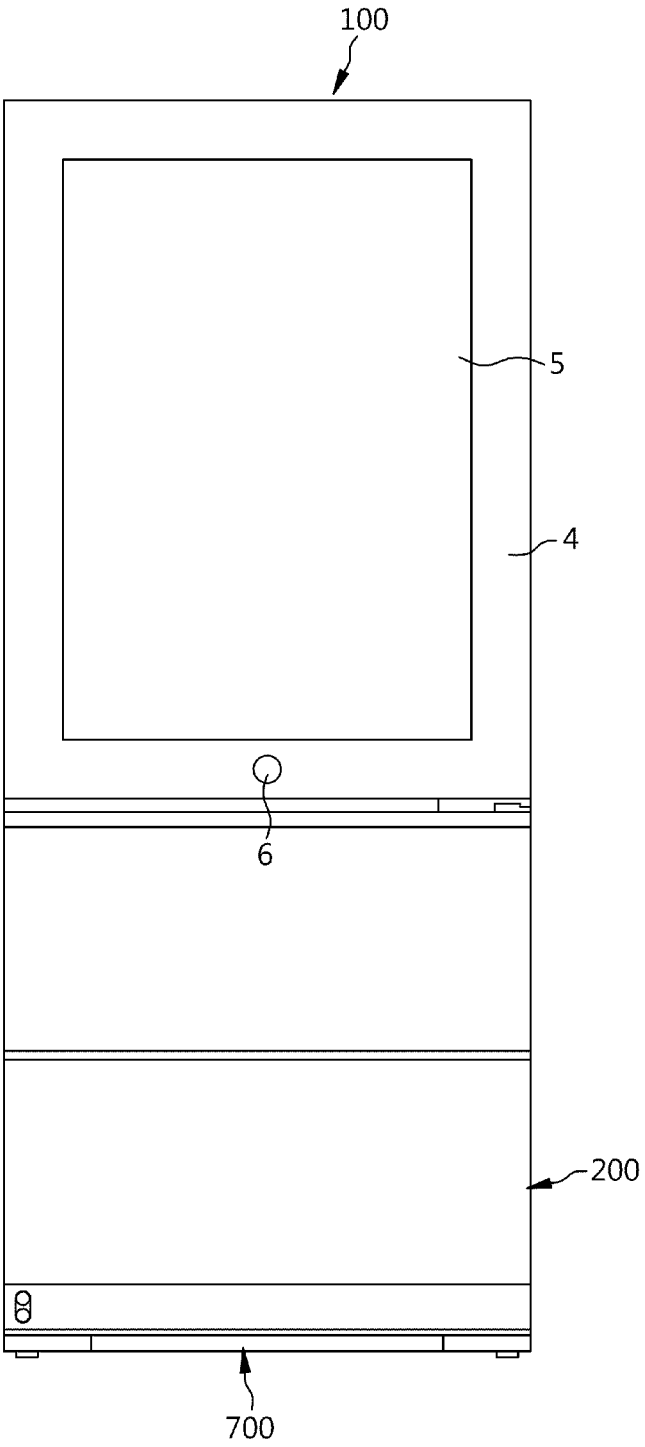
FIG. 2 is a front view illustrating the refrigerator according to the embodiment of the present disclosure.
Figure 3:
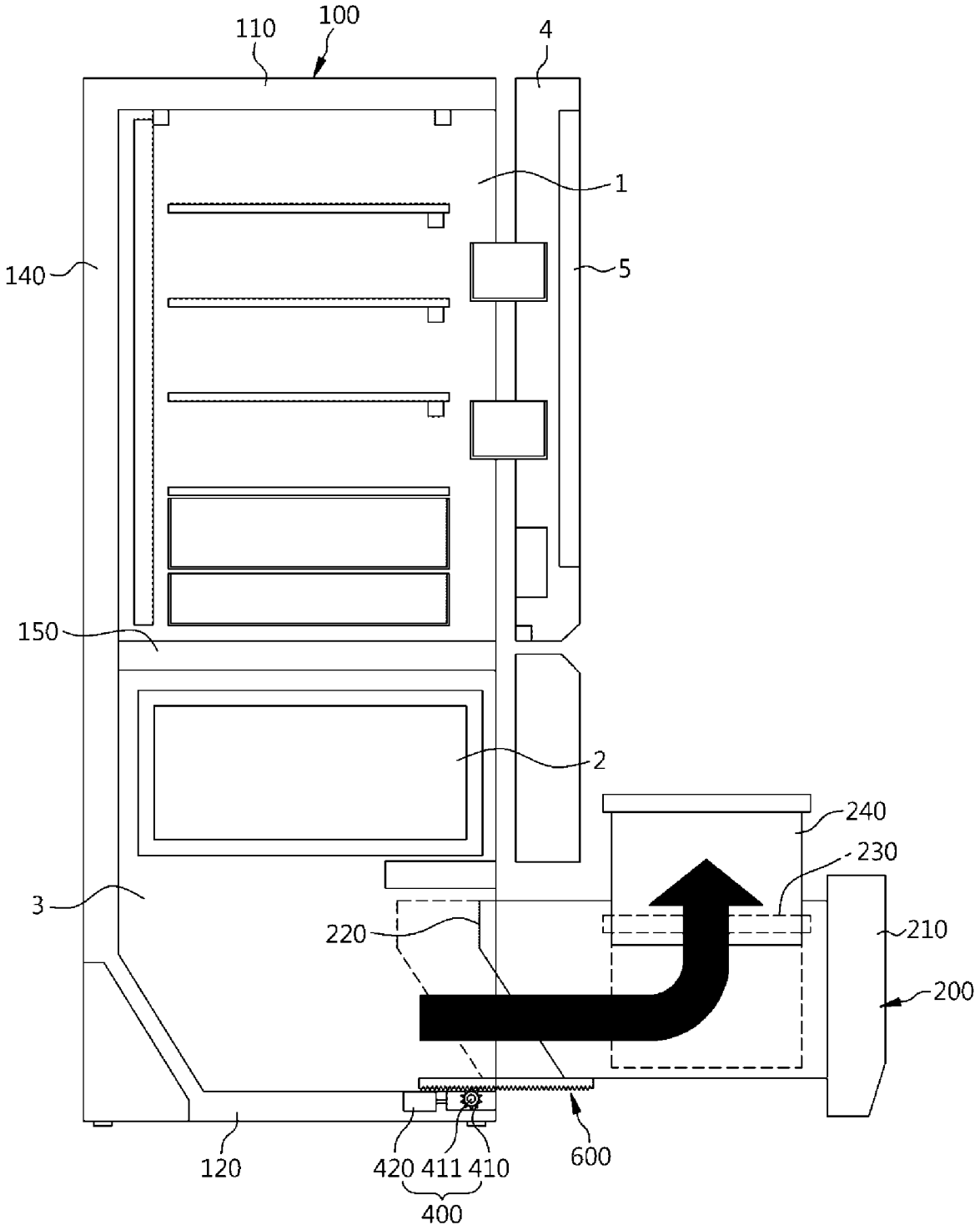
FIG. 3 is a side view illustrating the refrigerator according to the embodiment of the present disclosure.

In the refrigerator according to an embodiment of the present disclosure depicted in FIGS. 1-3, a storage space in the cabinet 100 may be vertically divided into three chambers (e.g., upper storage chamber 1, middle storage chamber 2, and lower storage chamber 3). The storage space may be divided, for example, such that the upper storage chamber 1 may be used as a refrigerating compartment, and the center storage chamber 2 and the lower storage chamber 3 may be used one or more of a refrigerating compartment, a freezer compartment, or as an independent space.

Each storage chamber 1, 2, and 3 of the cabinet 100 may be separately opened and closed. For example, the upper storage chamber 1 may be accessed by a swinging door 4, and the center storage chamber 2 and the lower storage chamber 3 may be accessed by the drawer 200, as illustrated in FIG. 3. In another example, the center storage chamber 2 may be configured to be accessed via the swinging door 4.

The swinging door 4 may be hingedly coupled to the cabinet 100, and the swinging door 4 may rotate to open or close an opening to the upper storage chamber 1. In certain examples, a display part (or display) 5 may be provided on a front surface of the swinging door 4 to output information. As used herein, a "front" direction may refer to a direction in which the door 4, the display part 5, and/or the drawer 200 are provided with respect to the cabinet 100. The display part 5 may output visual content, such as information related to an operation state of the refrigerator, temperatures the storage chambers 1, 2, and 3, etc. The display part 5 may include at least one of a liquid crystal display (LCD) screen or a light emitting diode (LED).

The drawer 200 is a structure that slides to open or close an opening in the cabinet 100, and in certain embodiments, the drawer 200 may be provided in the lower storage chamber 3. The drawer 200 may include a front panel 210 and a storage bin 220. In one example, the front panel 210 closes an open front of the lower storage chamber 3 and has an installation space therein. The front panel 210 includes one or more wall surfaces (e.g., an upper surface, opposite side surfaces, a front surface, and a lower surface) that may be formed by bending a thin metal plate, and may include an inner frame of a resin material to reduce weight. In another example, the front panel 210 may be formed of a non-metal material that approximates the feel of metal.

The storage bin 220 may be provided at a rear of the front panel 210 and may be received in the lower storage chamber 3. For example, the storage bin 220 may be configured as a box body, which is open upward. A front surface of the storage bin 220 may be fixed to a rear surface of the front panel 210 while the front surface of the storage bin 220 is in close contact with the rear surface of the front panel 210. The storage bin 220 may be coupled to the front panel 210 using various connectors, such as hooks, bolts, or screws, or the front panel 210 may include one or more sections the engage or otherwise fit against the storage bin.

Guide rails 230 may be provided on opposite outer surfaces of the storage bin 220 and on opposite inner wall surfaces of the lower storage chamber 3 to oppose each other such that the guide rails 230 engage each other to support stable forward and backward movements of the storage bin 220. Although not shown in the drawings, one or more guide rails 230 may be provided on each of a lower surface of the storage bin 220 and on an opposing bottom surface of the interior of the lower storage chamber 3 such that the guide rails 230 may engage each other. In addition, the guide rail 230 may be configured to extend in multiple steps.

In addition, a container 240 may be further provided in the storage bin 220. Although various kinds of food may be stored in the storage bin 220, the container 240 may be received into the storage bin 220 such that one or more kinds of food may be stored in the container 240. The container 240 may be, for example, a kimchi container or a container having an open upper part.

When the storage bin 220 is opened from the lower storage chamber 3, the container 240 may be configured to move upward in the storage bin 220. For example, a sufficient gap is provided for a user's finger to enter a gap between the storage bin 220 and the container 240 such that the user can lift the container 240 received in the storage bin 220. Accordingly, a size of the container 240 may decrease to provide sufficient space for the gap between the storage bin 220 and the container 240. Accordingly, to maximize the size of the container 240, the container 240 may be automatically removed from the storage bin 220. For example, the container 240 may be automatically removed from the storage bin 220, such that a withdrawal of the container 240 by the user is not needed.

Figure 4:
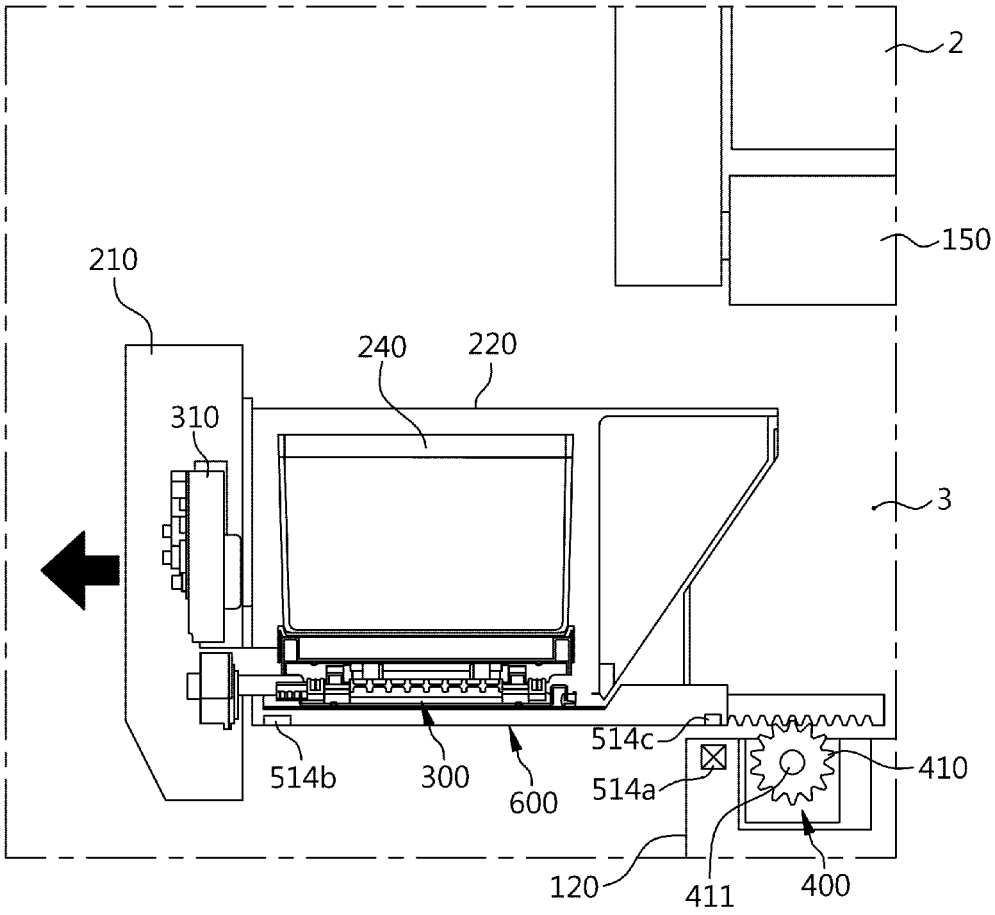
FIG. 4 is a state view of an important part roughly illustrating an opened state of a drawer of the refrigerator according to the embodiment of the present disclosure.
Figure 5:
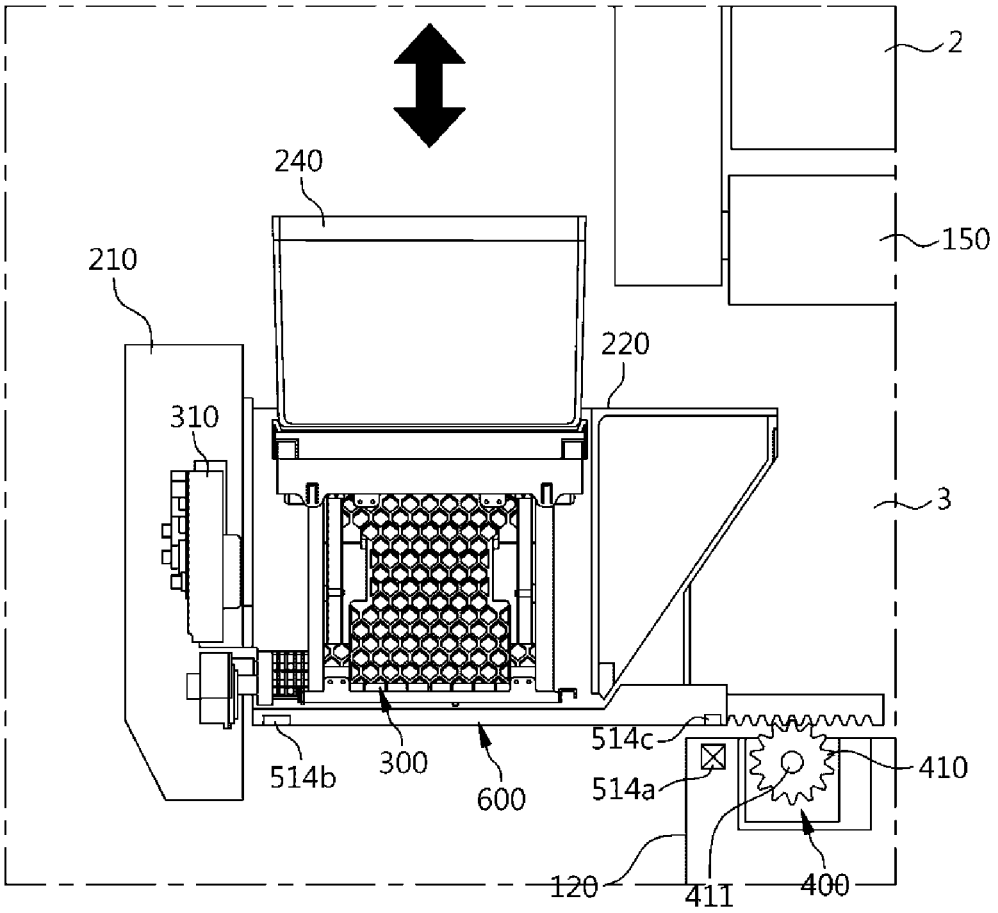
FIG. 5 is a state view of an important part roughly illustrating a state of a container moving upward in the opened state of the drawer of the refrigerator according to the embodiment of the present disclosure.
Figure 6:
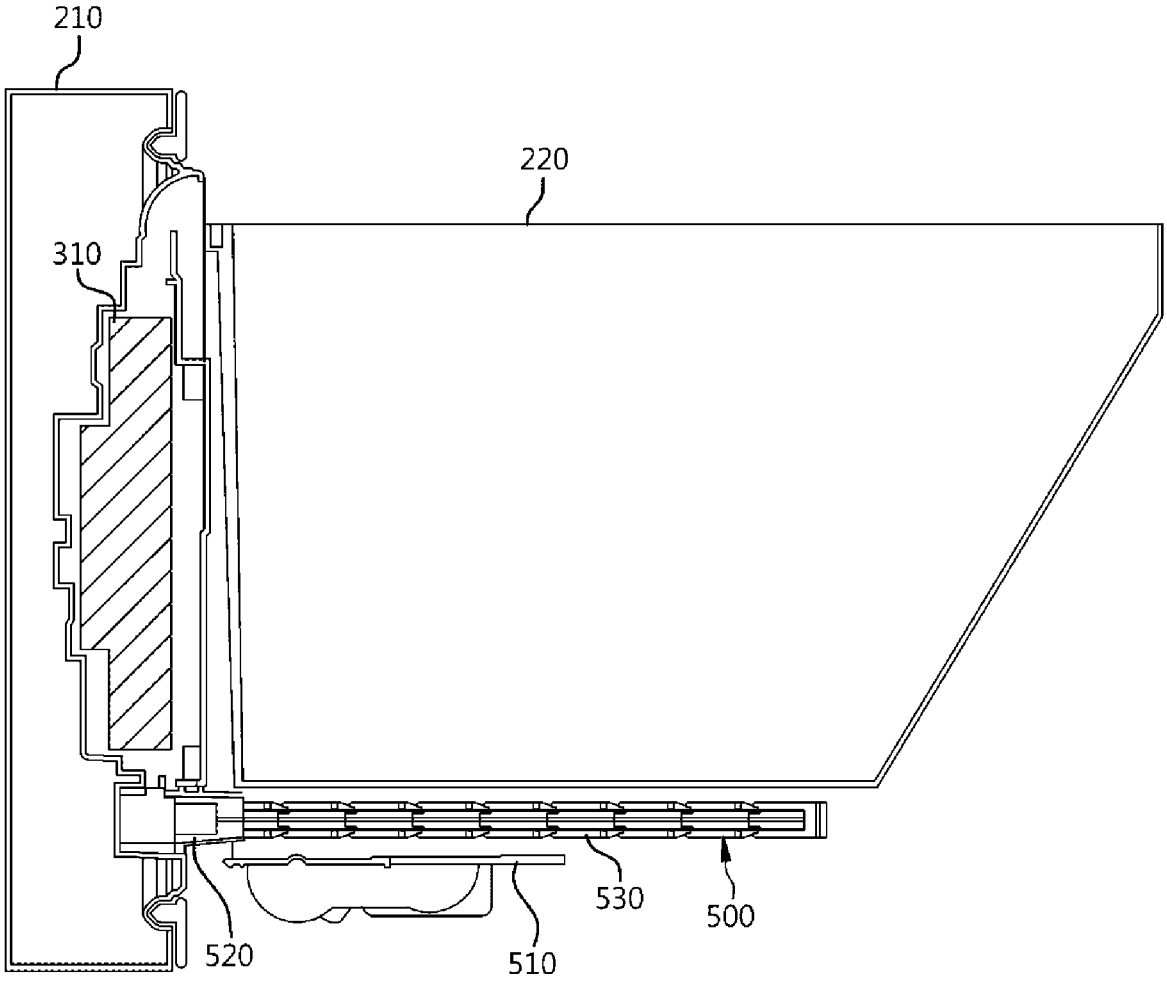
FIG. 6 is a side view illustrating a state of a cable guide module connected to the drawer of the refrigerator according to the embodiment of the present disclosure.

To automatically removed the container 240 from the storage bin 220, the storage bin 220 may further include a lift module 300 that automatically raises and lowers the container 240. The lift module 300 may be implemented in various forms. For example, the lift module 300 may be configured to have a scissor-type link structure such that when the lift module 300 is folded, a height thereof is minimized and when the lift module 300 is spread, the height thereof is maximized. This feature is shown in FIGS. 4 and 5.

In addition, electric components 310 (See FIG. 6), such as a driving motor to provide a driving force for lifting and lowering the lift module 300, may be positioned in the installation space inside the front panel 210. If the lift module 300 operates before the storage bin 220 of the drawer 200 is completely opened (e.g., within the cabinet 100), the container 240 and/or the cabinet 100 may be damaged. Accordingly, a controller to manage the operation of the lift module 300 may be program to operate only when the storage bin 220 is completely opened.

The driving part 400 may provide a driving force to allow the drawer 200 to automatically move forward and backward. As illustrated in FIGS. 3 to 5, the driving part 400 may be positioned at the bottom 120 of the cabinet 100 and may include a pinion 410 and a driving motor 420. In one configuration, the pinion 410 may be positioned to expose at least a portion of the pinion 410 to the inner region of the lower storage chamber 3, such as the pinion 410 being upward formed through a bottom surface of the lower storage chamber 3 (e.g., from an upper surface of the bottom 120 of the cabinet), and the driving motor 420 may be fixed to the bottom 120 of the cabinet 100 so as to transmit power to the pinion 410.

In one embodiment, pinions 410 may be positioned, respectively, on opposite sides of the bottom surface of the interior of the lower storage chamber 3. In this example, each of the pinions 410 may be connected to a power transmission shaft 411, and the driving motor 420 may be connected to the power transmission shaft 411 by a belt, a chain, a gear, etc. to transmit power thereto. In this configuration, each of the pinions 410 may be simultaneously rotated at a same speed and in a same direction by driving force of the driving motor 420. Additional components, such as a reduction gear, may be further provided at a connection interface of the power transmission shaft 411 and the driving motor 420. In one configuration, the pinions 410 may be preferably positioned at a front side of a bottom surface of the lower storage chamber 3 to allow the drawer 200 to be maximally opened.

The driving motor 420 may be activated to provide a driving force to the power transmission shaft 420 based on detecting a proximity of a user or when a user manipulate a button 6 or other input device on the refrigerator. For example, the button 6 may be a touch-type button provided on the display part 5 of the swinging door 4. In other examples, the button 6 may be a press button provided at a position separate from the display part 5.

A cable guide module (or cable guide) 500 may be connected to the bottom surface (the upper surface of the bottom) of the inner part of the lower storage chamber 3 and the front panel 210. Various kinds of power lines or cables may extend along an inner part of the bottom 120, and the cable guide module 500 may be configured to protect power lines or cables (hereinbelow, referred to as "cable") connected to electrical components in the front panel 210. For example, the cable guide module 500 may be configured to prevent a power cable from being damaged by being twisted or scratched during the forward or backward movement of the drawer 200.

To this end, the cable guide module 500 may include a cover plate 510, a guiding head 520, multiple connecting members (or connecting segments) 530, a swinging connection member (or swinging connection base) 540 and a mounting plate 550, as shown in FIGS. 7 to 10. The cable guide module 500 will be described in greater detail below.

The cover plate 510 of the cable guide module 500 may be combined with the upper surface of the bottom 120 of the cabinet 100. A front portion of the upper surface of the bottom 120 may be configured to be open, and the cover plate 510 may be combined with the bottom 120 so as to cover the open portion of the bottom 120.

Figure 7:
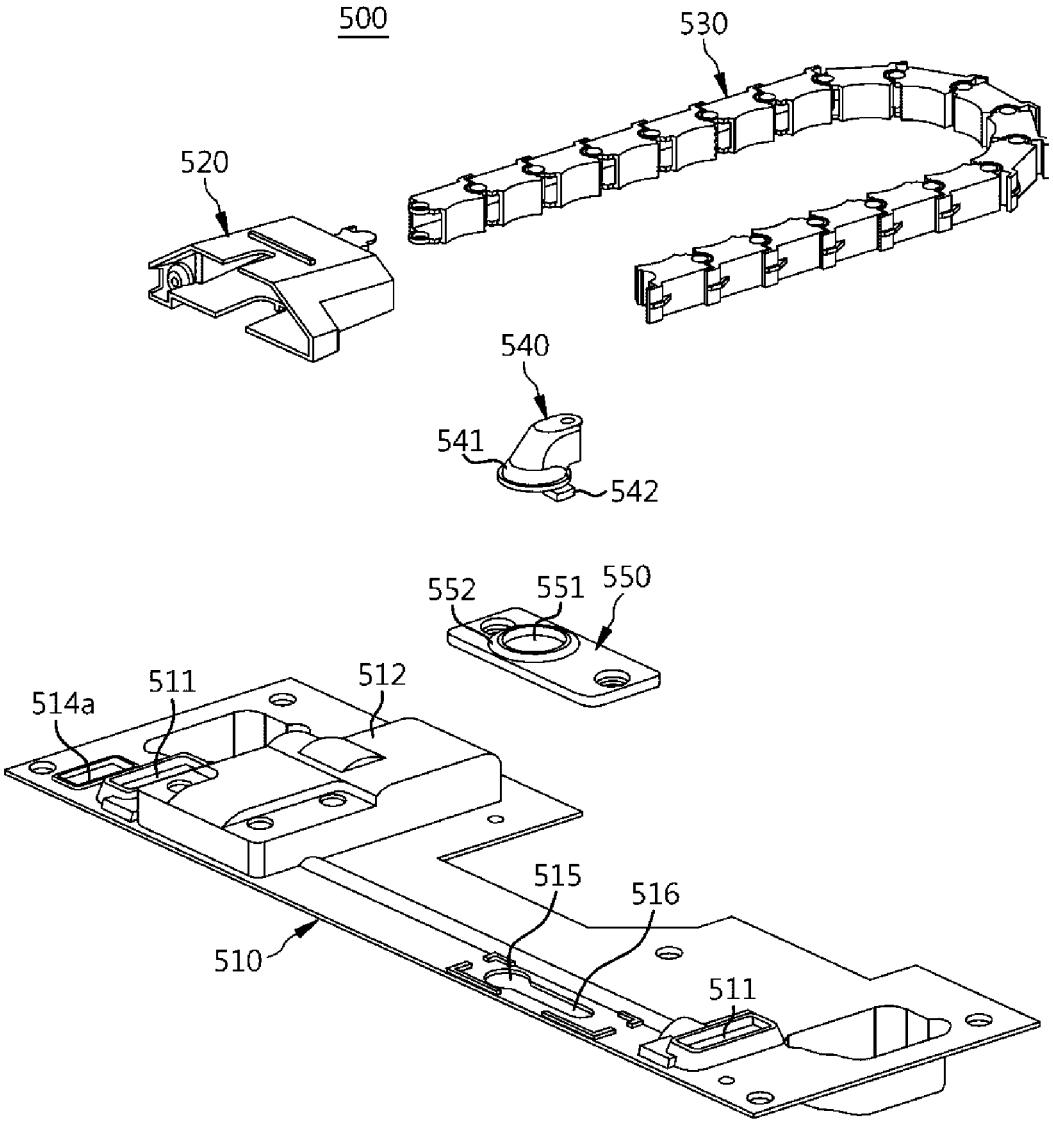
FIG. 7 is an exploded perspective view illustrating the cable guide module of the refrigerator according to the embodiment of the present disclosure.
Figure 8:
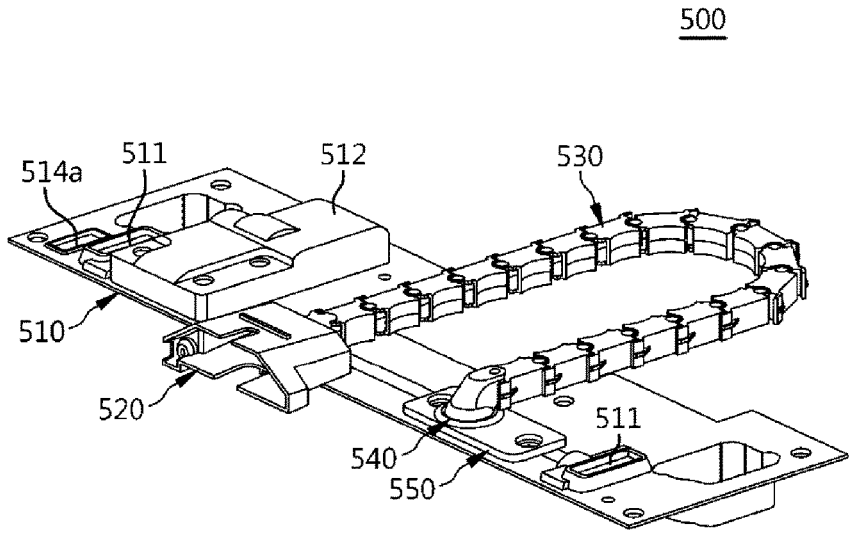
FIG. 8 is an assembled perspective view illustrating the cable guide module of the refrigerator according to the embodiment of the present disclosure.
Figure 9:
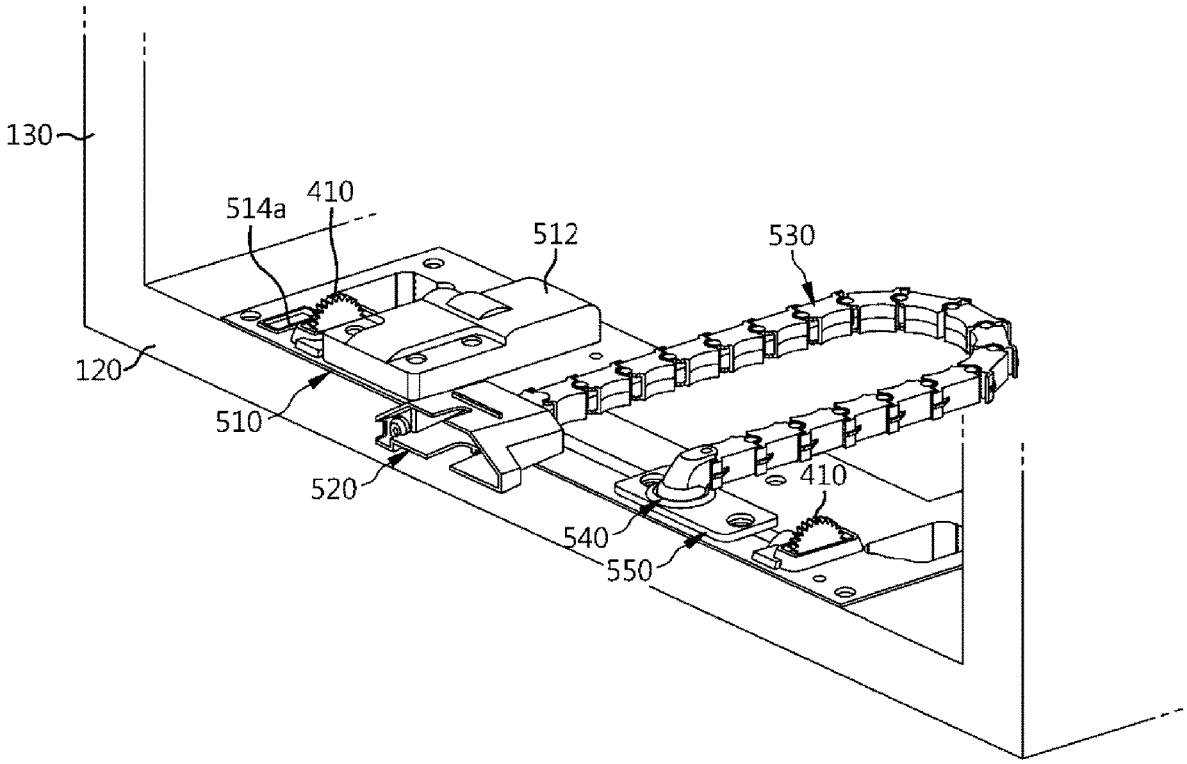
FIG. 9 is a perspective view illustrating a state in which the cable guide module of the refrigerator according to the embodiment of the present disclosure is installed in a storage chamber of the refrigerator.
Figure 10:
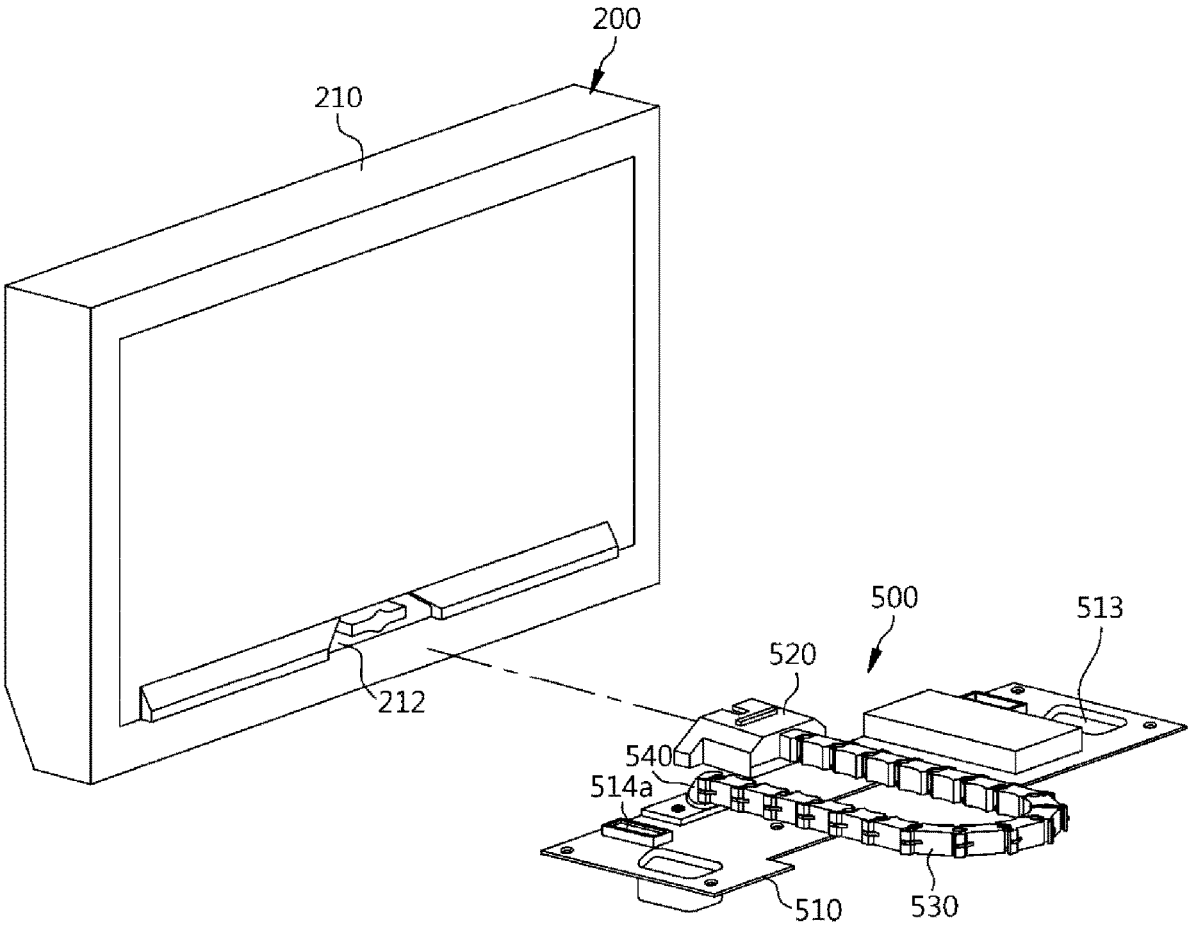
FIG. 10 is a perspective view, from a rear side of the drawer, illustrating a state in which the cable guide module of the refrigerator according to the embodiment of the present disclosure is connected to the drawer.

As illustrated in FIGS. 7 and 8, pinion exposure holes 511 may be provided on opposite sides of the cover plate 510 such that the pinions 410 included in the driving part 400 may be exposed to the interior of the lower storage chamber 3 via the pinion exposure holes 511.

In addition, a motor receiving part (or motor mount) 512, into which the driving motor 420 included in the driving part 400 may be received, may be positioned on the cover plate 510. The motor receiving part 512 may be formed, for example, by protruding a portion of the cover plate 510 upward or may be manufactured independently in other method and in other shapes and coupled to the cover plate 510.

In addition, protrusion passing holes (or protrusion receiving hole) 513 may be provided on a rear of opposite sides of the cover plate 510 (see FIG. 10) and may receive a confining protrusion part 650 therein, which will be described later. The confining protrusion part 650 may be positioned so that an upper end thereof is exposed to the inner part of the lower storage chamber 3 while another portion of the confining protrusion part 650 is received in the protrusion passing hole 513. The confining protrusion part 650 will be described with respect to the rack gear assembly 600.

In addition, an open/close sensing part (or sensor) **514*a*, 514*b* may provided on any one side of the cover plate 510 so as to detect the closing and opening state of the drawer 200. The open/close sensing part 514*a*, 514*b* may be a magnetic sensor, such as a Hall sensor, and a magnet, which can be detected by the Hall sensor, may be provided on the lower surface of the storage bin 220. In other implementations, the open/close sensing part 514*a*, 514*b* may additionally or alternatively include various structures such as optical sensors and switches and may also be positioned at other locations on the cabinet 100 and/or the drawer 200**.

Next, the guiding head 520 of the cable guide module 500 may be coupled to the front panel 210. For example, an installation hole 212 may be provided on the front panel 210, such at a center lower portion of a rear surface of the front panel 210, and the guiding head 520 may pass through a portion of the installation hole 212 and be coupled to the rear surface or other portion of the front panel 210.

The connecting members 530 of the cable guide module 500 may flexibly connect the swinging connection member 540 to the guiding head 520. Each of the connecting members 530 may be configured as a tube body having an substantially hollow inner core and may be continuously connected to each other such that at least one cable may sequentially pass through the inner core of each of the connecting members 530.

In one implementation, the connecting members 530 have a chain-type connection structure. For example, a connection portion between each of the connecting members 530 may be configured to be rotatable in a horizontal direction. A first end of the connecting member 530 may be rotatably connected to the swinging connection member 540, and a second end of the connecting member 530 may be rotatably connected to the guiding head 520. When the drawer 200 moves forward or backward, the connecting members 530 move the cable together therewith by operating in cooperation with each other.

The swinging connection member 540 of the cable guide module 500 may be rotatably connected to the cover plate 510. A cable through hole 515 may be provided in the cover plate 510 so as to allow the cable to pass therethrough, and the swinging connection member 540 may have a pipe structure with an end position in close contact with an upper surface of the cover plate 510 when the swinging connection member 540 is coupled to the cover plate 510.

An extension end 541 having a dome structure may be provided at an end portion of the swinging connection member 540, and the extension end 541 gradually extending toward the end thereof. For example, an extension hole 516 may be provided to extend from a circumference surface of the cable through hole 515, and a confining protrusion 542 may be provided on a circumference of the extension end 541 of the swinging connection member 540 and may pass through the extension hole 516 to couple the swinging connection member 540 to the cover plate. For example, the confining protrusion 542 may protrude radially outward from a circumference surface of the extension end 541.

In this case, the extension hole 516 may be formed to have a sufficiently narrow width to allow the confining protrusion 542 to pass therethrough. After the confining protrusion 542 passes through the extension hole 516, the swinging connection member 540 may be slightly rotated to be prevented from being removed from the cable through hole 515 of the cover plate 510.

The mounting plate 550 of the cable guide module 500 is provided to prevent a movement deviation of the swinging connection member 540 when connected to the cover plate 510. The mounting plate 550 may be fixed to the cover plate 510, and may include a communicating hole 551 that is positioned to correspond to the cable through hole 515. The mounting plate 550 may also include a covering end 552 that protrudes vertically from a circumference surface of the communicating hole 551 to cover a portion of the extension end 541 of the swinging connection member 540. An inner surface of the covering end 552 may have the same surface curvature (e.g., be a spherical surface) as an outer surface of the extension end 541 so as to be in close contact therewith.

Next, the rack gear assembly 600 of the refrigerator according to the embodiment of the present disclosure will be described. The rack gear assembly 600 is a device to automatically move the drawer 200 forward and backward due to a driving force of the driving part 400 provided in the cabinet 100.

Figure 11:
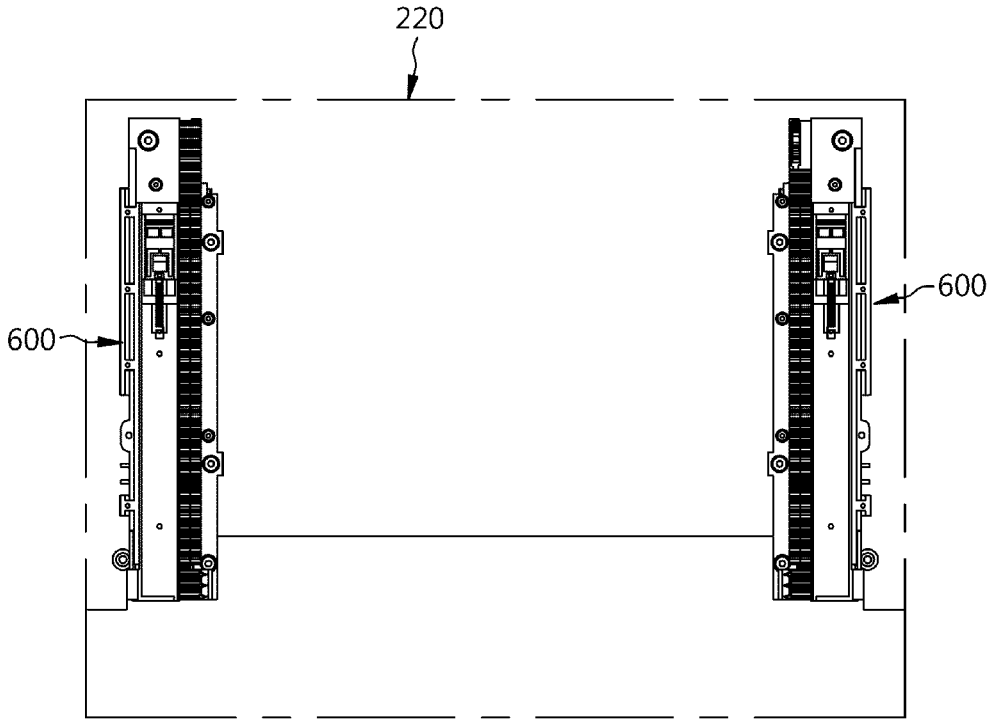
FIG. 11 is a bottom view illustrating installation states of rack gear assemblies of the refrigerator according to the embodiment of the present disclosure.
Figure 12:
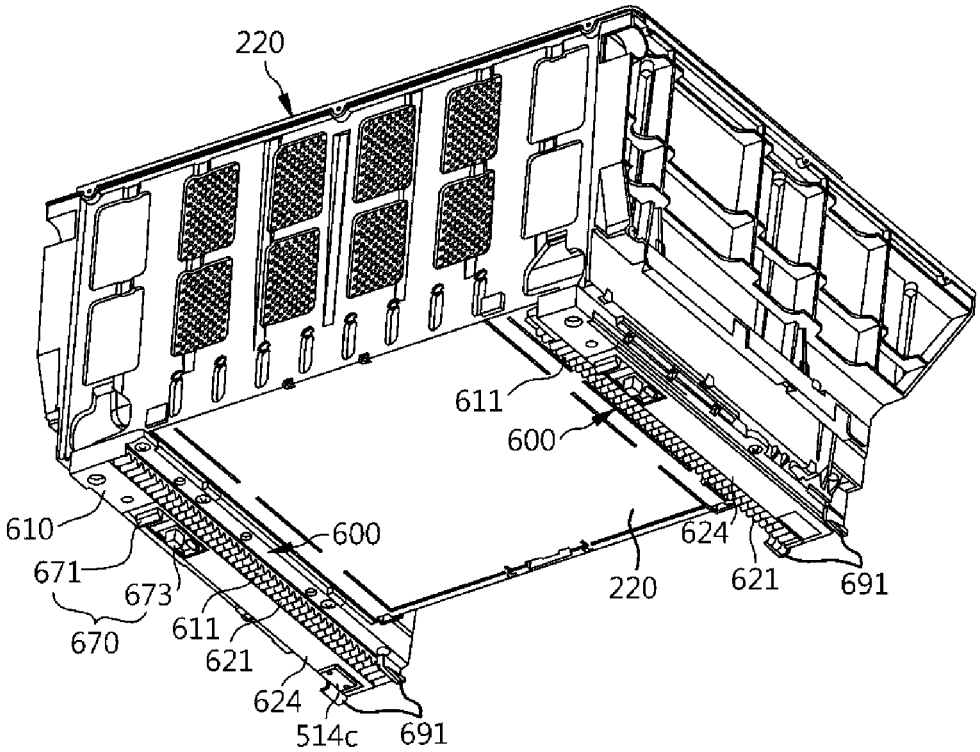
FIG. 12 is a perspective view illustrating the installation state of each of the rack gear assemblies of the refrigerator according to the embodiment of the present disclosure from a lower portion thereof.
Figure 13:
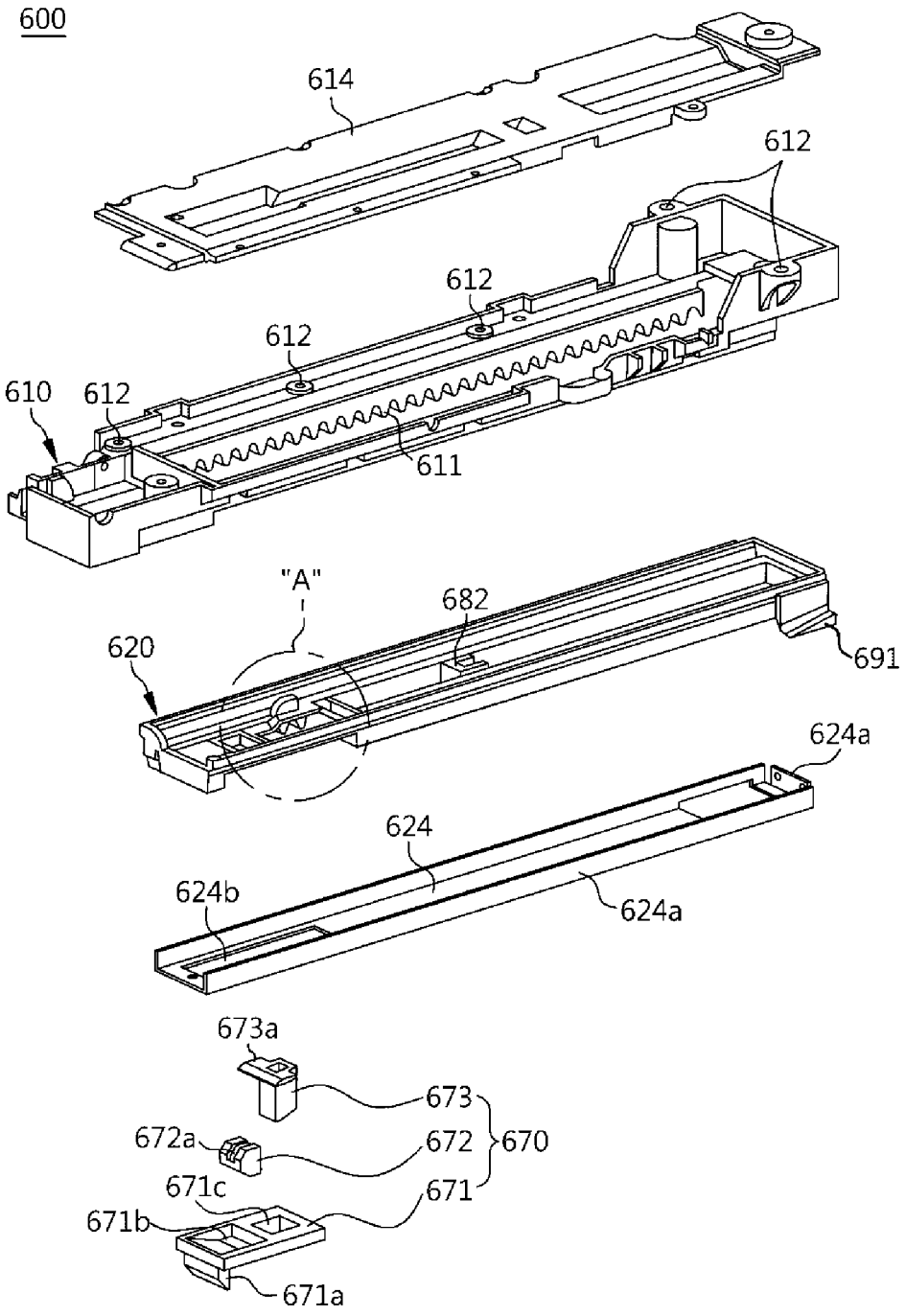
FIG. 13 is an exploded perspective view illustrating a state of the rack gear assembly of the refrigerator according to the embodiment of the present disclosure from an upper portion thereof.
Figure 14:
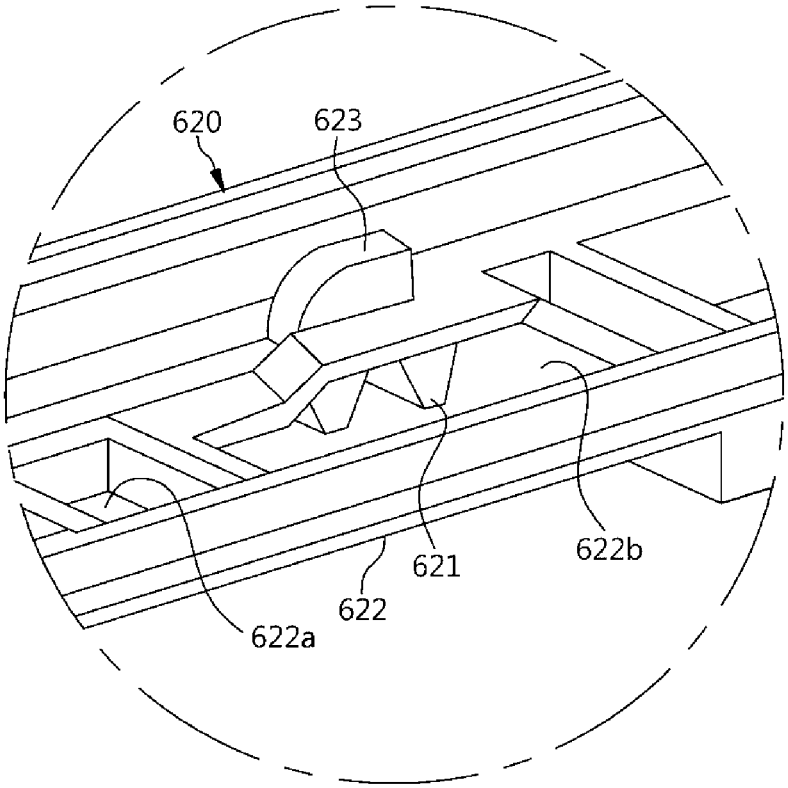
FIG. 14 is an enlarged view of an "A" portion of FIG. 13.
Figure 15:
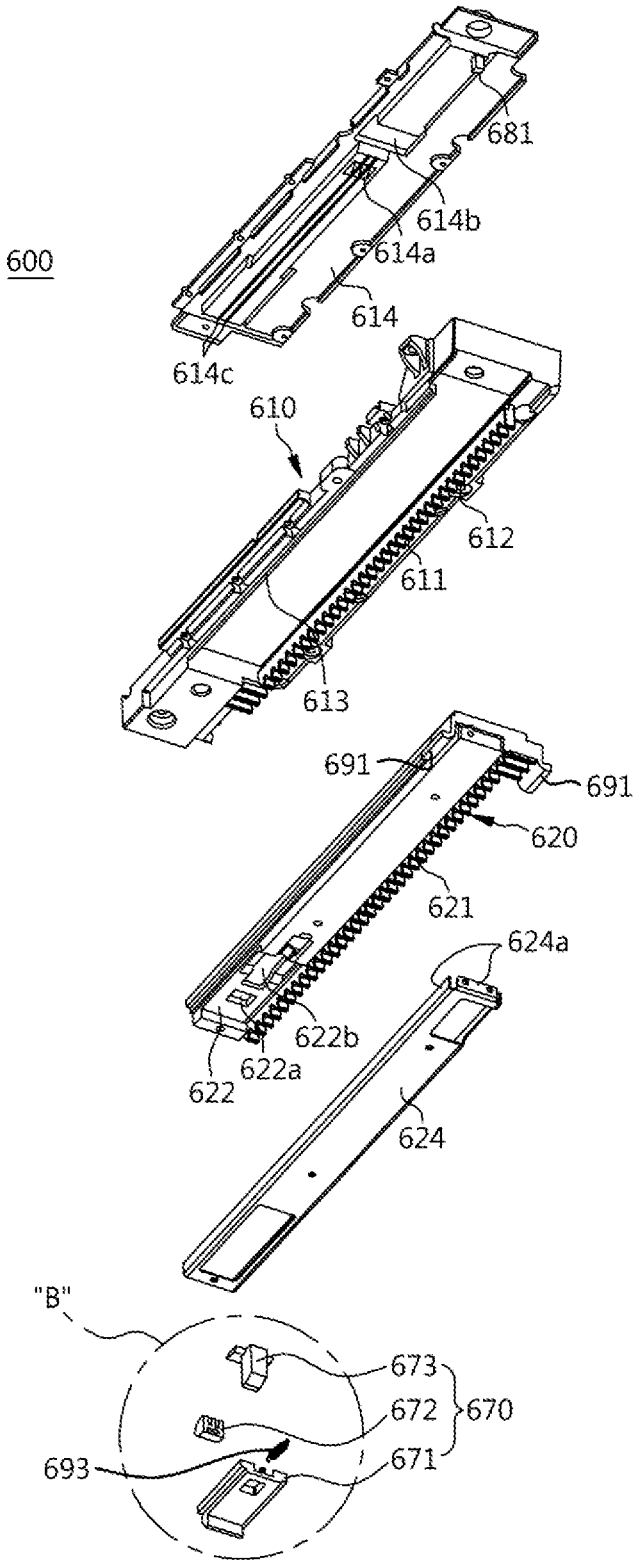
FIG. 15 is an exploded perspective view illustrating a state of the rack gear assembly of the refrigerator according to the embodiment of the present disclosure from the lower portion thereof.
Figure 16:
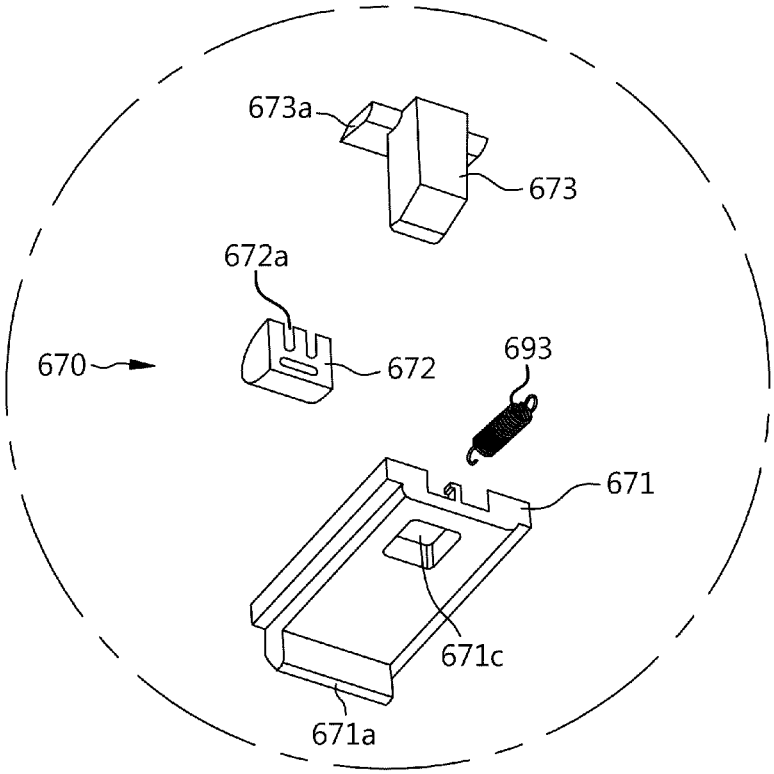
FIG. 16 is an enlarged view of a "B" portion of FIG. 15.
Figure 17:
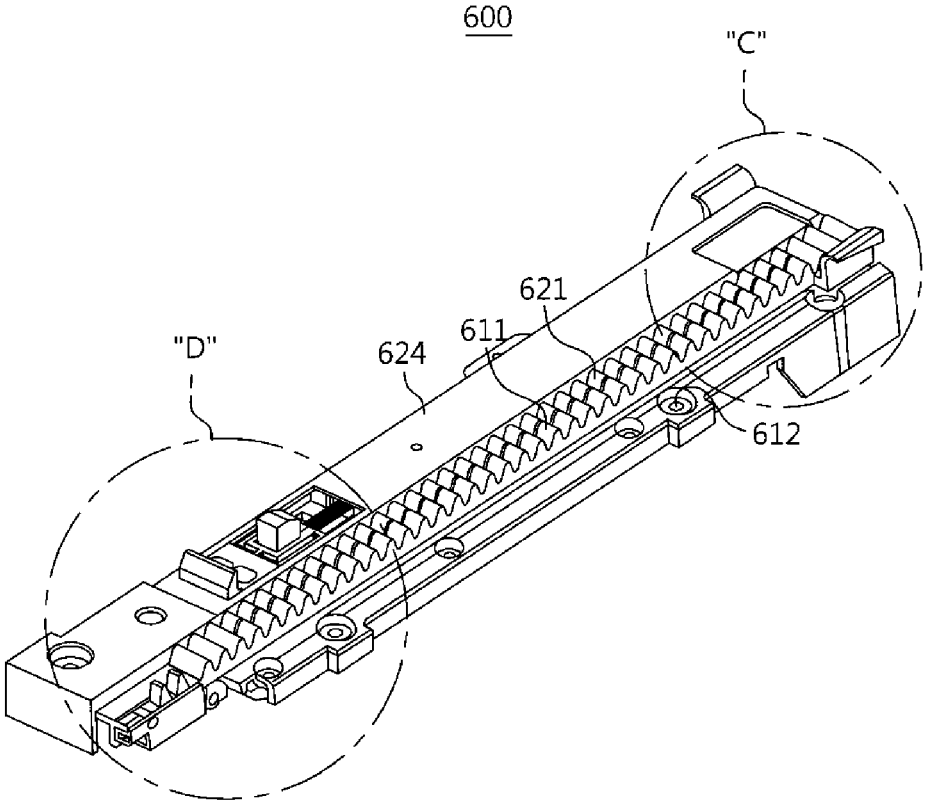
FIG. 17 is a perspective view of the rack gear assembly upside down to illustrate a structure of a lower surface of the rack gear assembly of the refrigerator according to the embodiment of the present disclosure.

As illustrated in FIGS. 11 and 12, the rack gear assemblies 600 may be provided on opposite sides of the lower surface of the storage bin 220 included in the drawer 200. In other examples, a single rack gear assembly is included and positioned at a center or side of the drawer 200. In another example, three or more of each of the pinion 410 and the rack gear assembly 600 may be provided and paired with each other, such as positioning rack gear assemblies 600 at a center and at opposite sides of the drawer 200.

The rack gear assembly 600 may have rack gears 611 and 621 provided on a lower surface thereof such that gear teeth of the pinion 410 may be exposed to the inner part of the lower storage chamber 3 and engage the rack gears 611 and 621. In addition, the rack gears 611 and 621 of the rack gear assembly 600 may extend between a front side of the lower surface of the storage bin 220 to a rear side thereof. Accordingly, the drawer 200 provided with the rack gear assembly 600 can moved away from or moved close to the lower storage chamber 3 while the drawer 200 is moved forward and rearward by a rotating movement of the pinion 410.

Meanwhile, as a distance that the drawer 200 moves when automatically opening increases, convenience of use thereof improves. For example, as the storage bin 220 is maximally moved away from the lower storage chamber 3 by the drawer 200, it becomes easy to house the container 240 in the storage bin 220 or to store items or food in the storage room. Furthermore, since the container 240 is automatically raised by the lift module 300 when the drawer 200 is opened, it is preferable for the storage bin 220 to maximally move away from the lower storage chamber 3.

To maximize a movement distance of the drawer 200, each of the opposite pinions 410 may be located at a front portion of the lower storage chamber 3, and each of the rack gears 611 and 621 may be configured to be able to maximally extend. For example, as each of the opposite pinions 410 may be located close to a front end of the lower storage chamber 3 and the rack gears 611 and 621 extend, an opening distance of the storage bin 220 may increase. However, in certain implementations, a bottom surface of the storage bin 220 may be configured to be shorter in length from front to rear than an open upper surface of the storage bin 220 (see, for example, FIGS. 4 and 5), there is a limit to extending the rack gears 611 and 621.

Accordingly, according to the embodiment, the rack gear assembly 600 may be configured to extend such that the opening distance of the storage bin 220 increases. For example, although a length between the front to rear of the storage bin 220 may be relatively short, the rack gear assembly 600 may extend such that the storage bin 220 is opened farther.

To this end, in an embodiment, the rack gear assembly 600 includes a first rack member (or first rack) 610, a second rack member (or second rack) 620, and a confining module (or coupler) 670 that move forward sequentially. The rack gear assemblies 600 will be described in detail with respect to FIGS. 13 to 21.

As previously described, the first rack member 610 may be configured to allow the storage bin 220 to be moved forward and backward by rotation of the pinion 410, wherein the first rack member 610 includes the rack gear (or first rack gear) 611. The first rack member 610 is configured to be fixed to the storage bin 220 while an upper surface of the first rack member 610 is in close contact with a lower surface of the storage bin 220. In this case, a plurality of coupling holes 612 are provided in the first rack member 610 such that the first rack member 610 is screwed to the storage bin 220.

In addition, the first rack member 610 includes a movement guiding groove 613 provided in the lower surface thereof by being recessed therefrom, the movement guiding groove supporting a sliding movement of the second rack member 620 while the second rack member 620 is received in the movement guiding groove 613. A movement guiding groove 613 may be configured to be recessed from a front end portion of the first rack member 610 and to be formed through a rear surface of the first rack member 610. For example, the second rack member 620 may be received in the movement guiding groove 613 may be exposed to the rear of the movement guiding groove 613.

In addition, the rack gear 611 of the first rack member 610 may be provided at any one side of the movement guiding groove 613 (an opposing direction side of each of the opposite rack gear assemblies) in a longitudinal direction of the first rack member 610. For example, the rack gear 611 may be formed to a portion located at a further front side compared to the movement guiding groove 613.

Meanwhile, the first rack member 610 may further include a first rack cover 614. For example, an inner portion of the movement guiding groove 613 provided in the first rack member 610 may be configured to be open upward and downward. Accordingly, the movement guiding groove 613 may be configured to allow a holder 672 and a locking member (or latch) 673 of the confining module 670, which will be described later, to pass therethrough. The first rack cover 614 may be coupled to the first rack member 610 to cover the upper surface of the first rack member 610, and a lower surface of the first rack cover 614 may be configured to cover the open portion of the movement guiding groove 613 provided in the first rack member 610 and to form an upper surface of the movement guiding groove 613. In one implementation, the first rack cover 614 is provided to be a metal plate so as to reinforce an insufficient rigidity of the first rack member 610.

In addition, a lower surface (an upper surface of an inner part of the movement guiding groove) of the first rack cover 614 may include receiving grooves 614*a* and 614*b* provided thereon. The holder 672 and the locking member 673 of the confining module 670, to be described later, may be received into the receiving grooves 614*a* and 614*b*, respectively. The receiving grooves 614*a* and 614*b* may include a first receiving groove 614*a* receiving the holder 672 and a second receiving groove 614*b* receiving the locking member 673. The two receiving grooves 614*a* and 614*b* may be spaced apart from each other along a moving direction of the first rack member 610. For example, a distance between a rear surface of the first receiving groove 614*a* and a rear surface of the second receiving groove 614*b* may be longer than a distance defined between a rear surface of the holder 672 and a rear surface of the locking member 673. After the holder 672 is first received into the first receiving groove 614*a*, the locking member 673 may be received into the second receiving groove 614*b*.

Accordingly, the first rack member 610 and the first rack cover 614 may be manufactured independently of each other and then coupled together. In another embodiment, the first rack cover 614 and the first rack member 610 may be provided as a single body, such forming the two components in a single body by injection molding. However, when the first rack member 610 and the first rack cover 614 are formed as the single body, the injection molding may be difficult to perform since a recessed shape or direction of each portion of the first rack member 610 and the first rack cover 614 may be different.

The second rack member 620 may move the storage bin 220 forward and backward in cooperation with the first rack member 610. For example, when the first rack member 610 receives a rotational force of the pinion 410 and moves forward by a predetermined distance while the second rack member 620 is received into the movement guiding groove 613 of the first rack member 610, the second rack member 620 may also be moved forward by being pulled by the first rack member 610. Subsequently, the second rack member 620 is moved forward by the rotational force of the pinion 410. Accordingly, although the rack gear 611 of the first rack member 610 moves away from the pinion 410, the first rack member 610 may be further extended.

Figure 26:
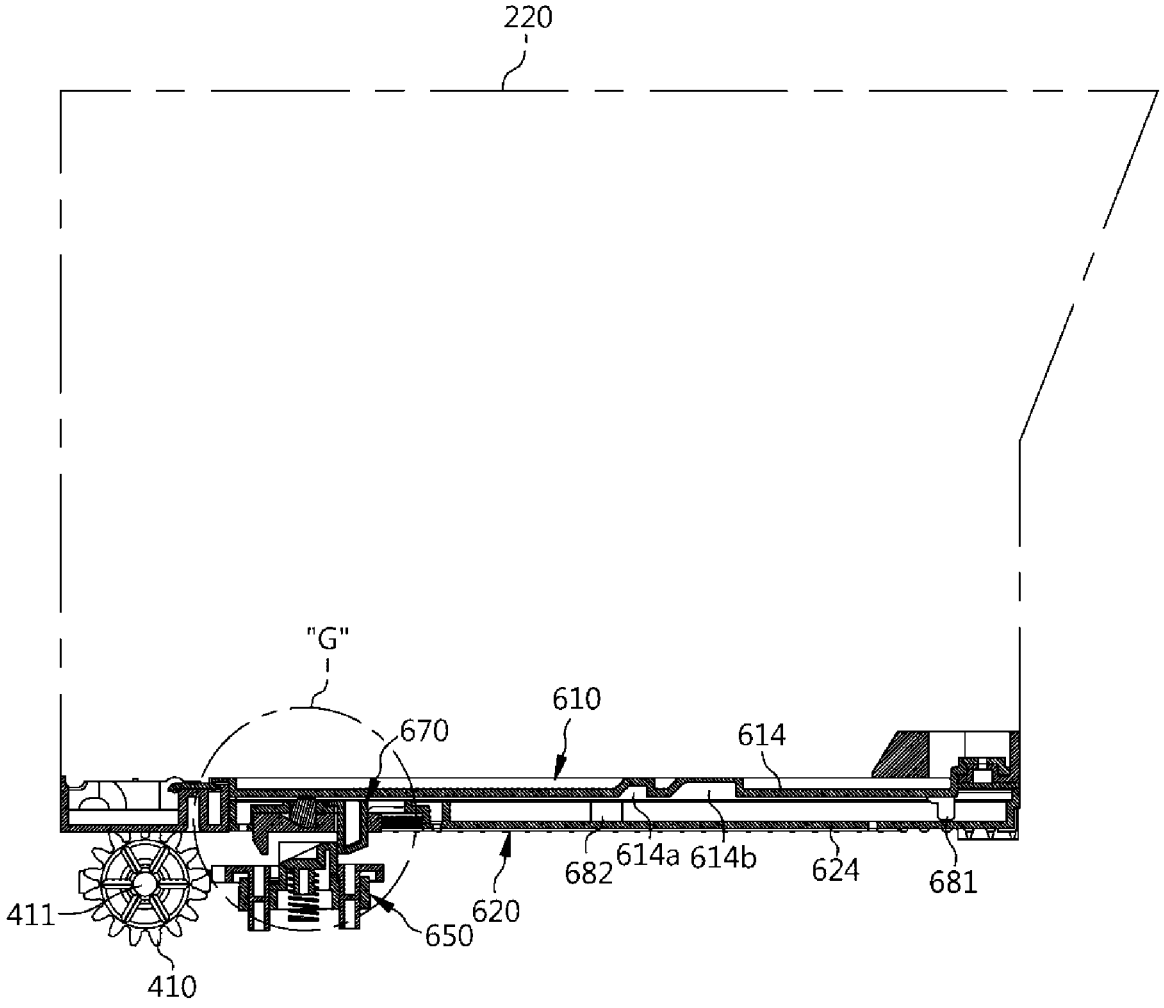
FIGS. 26, 28, 30, and 32 are operation state views illustrating operation states of the rack gear assembly in a process in which a storage bin of the refrigerator according to the embodiment of the present disclosure is opened.
Figure 28:
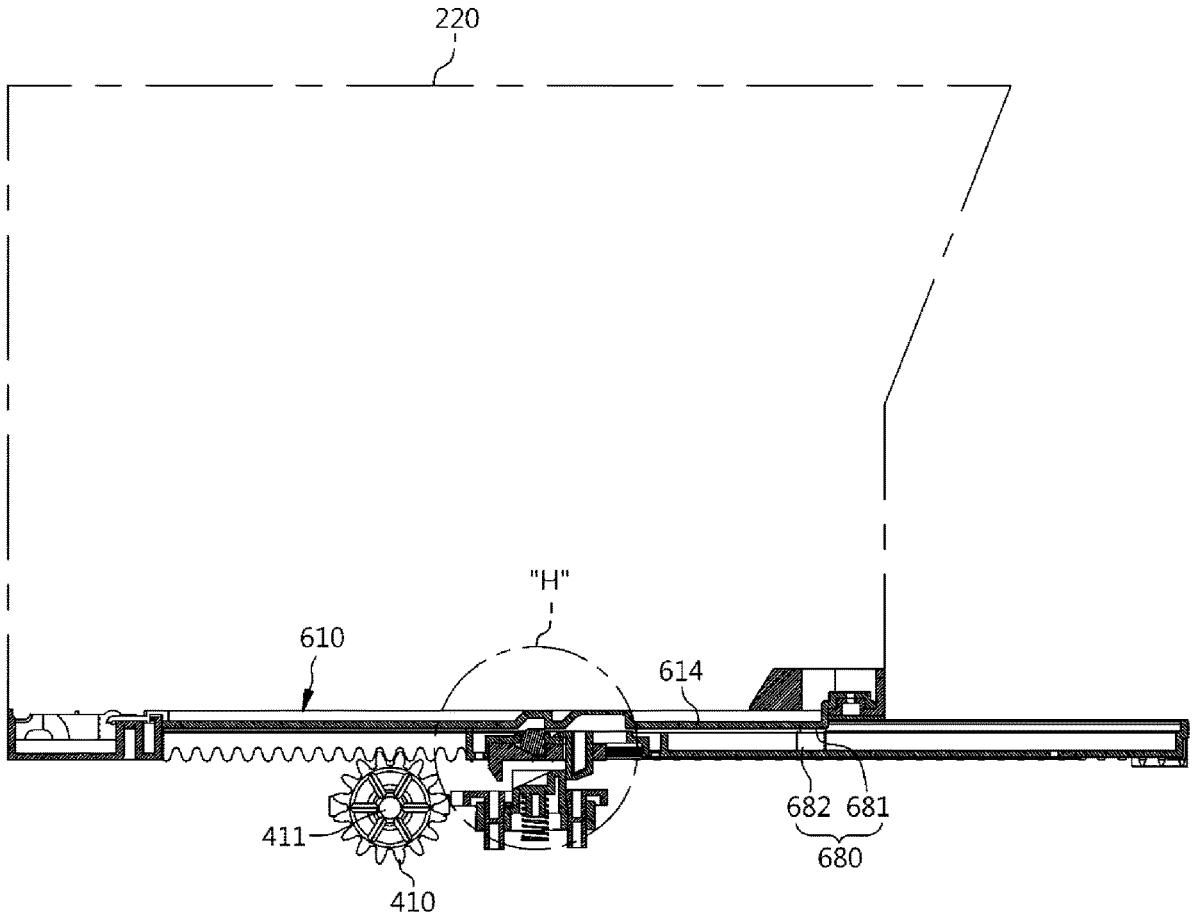

In certain configurations, the first rack member 610 may be configured to pull and move the second rack member 620 in cooperation with a linkage part 680. The linkage part 680 may include a linkage protrusion 681 (See FIG. 15) provided on a lower surface (the upper surface of the inner part of the movement guiding groove) of the first rack cover 614, which will be described later, and a linkage step 682 (See FIG. 13) provided on an upper surface of the second rack member 620. When the first rack member 610 moves forward by a predetermined distance, the linkage protrusion 681 and the linkage step 682 are configured to collide with each other and move the second rack member 620 forward, as illustrated in FIGS. 26 and 28.

In other examples, although not shown, the linkage protrusion 681 may be provided in the first rack member 610. In addition, although not shown, the linkage protrusion 681 may be provided on the upper surface of the second rack member 620 and the linkage step 682 may be provided on a lower surface of the first rack member 610.

Furthermore, while the second rack member 620 is completely received into the movement guiding groove 613 of the first rack member 610, a distance defined between the linkage step 682 and the linkage protrusion 681 may be set such that the first rack member 610 moves forward without influencing the second rack member 620. This set distance may be determined in consideration of a size of the storage bin 220 and/or the entire opening distance of the storage bin 220.

In addition, the rack gear (or second rack gear) 621 may be provided in the second rack member 620. The rack gear 621 may be positioned in parallel with the rack gear 611 of the first rack member 610 at a side portion thereof. For example, a front end of the rack gear 621 may be positioned at a rear side compared to a front end of the rack gear 611 of the first rack member 610, and a rear end of the rack gear 621 may be configured to extend to a further rear side compared to a rear end of the rack gear 611 of the first rack member 610.

For example, the rack gears 611 and 621 of the first rack member 610 and the second rack member 620 may be configured to receive the driving force generated by the pinion 410. For example, the pinion 410 may be configured to have a width corresponding to a size of the rack gear 611 of the first rack member 610 and the rack gear 621 of the second rack member 620 when overlapped together such that each of the rack gears 611 and 621 accurately receives the driving force from the pinion 410.

In addition, a motion groove 622 may be formed to be recessed in a lower surface of a front end of the second rack member 620. The motion groove 622 may provide a moving space allowing a stopper member (or stopper frame) 671 of the confining module 670, which will be described later, to move forward and backward while the stopper member 671 is received in and mounted in the motion groove 622.

In addition, a plurality of through holes 622*a* and 622*b* may be provided in the motion groove 622 by being formed through an upper part thereof. The through holes 622*a* and 622*b* may include a first through hole 622*a* through which the holder 672 of the confining module 670, which will be described later, passes and a second through hole 622*b*, through which the locking member 673 passes. For example, the second through hole 622*b* may be formed to be a longitudinal hole in forward and backward directions such that the locking member 673 may move forward and backward within the second through hole 622*b*.

In addition, a second rack cover 624 may be provided on a lower surface of the second rack member 620. For example, the second rack cover 624 may be configured to cover the lower surface of the second rack member 620. The second rack cover 624 may prevent the stopper member 671 mounted to the motion groove 622 of the second rack member 620 from deviating to the outside.

The second rack cover 624 may be a plate made of a metal or other substantially strong material and is positioned to cover the lower surface of the second rack member 620. Accordingly, the second rack member 620 can be prevented from being deformed, e.g. twisting or bending, by the second rack cover 624. In some examples, at least one partial open portion may be provided on the second rack cover 624 to reduce weight thereof.

In one example, second rack cover 624 may include a folded end (or vertical walls) 624*a* on each of opposite side surfaces and a rear surface of the second rack cover 624 so as to cover a portion of each of the opposite side surfaces and the rear surface of the second rack member 620, thereby preventing twisting of the second rack member 620. In addition, a stopper exposure hole 624*b* may be provided at a front end portion of the second rack cover 624 and may allow a portion of the stopper member 671, which will be described later, to be exposed therethrough.

The second rack member 620 may incline forward due to weight of the storage bin 220 when the second rack member 620 moves, such that the rack gear 621 of the second rack member 620 may not be spaces apart from and not precisely engaged with the pinion 410 positioned at a rear of the second rack member 620. Accordingly, in certain embodiments, a structure is provided to press a rear end of the second rack member 620 downward such that the rack gear 621 of the second rack member remains exactly engaged with the pinion 410 when the second rack member 620 is moved.

Figure 21:
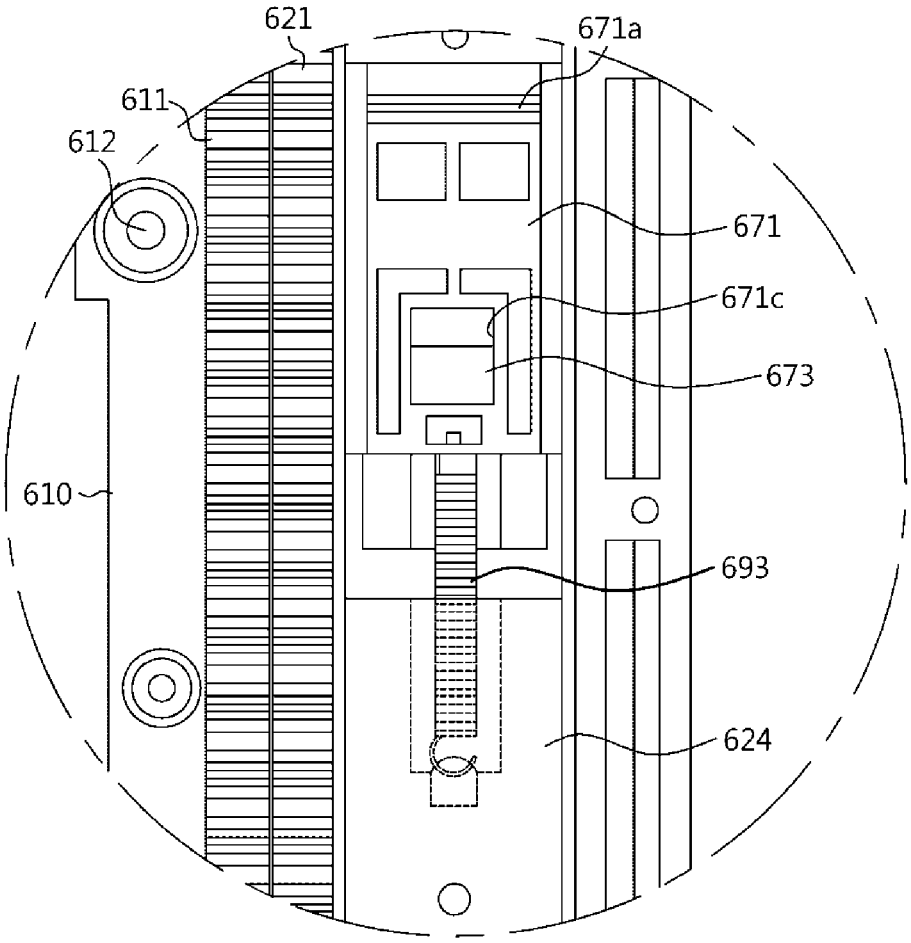
FIG. 21 is an enlarged view of an "E" portion of FIG. 20.
Figure 22:
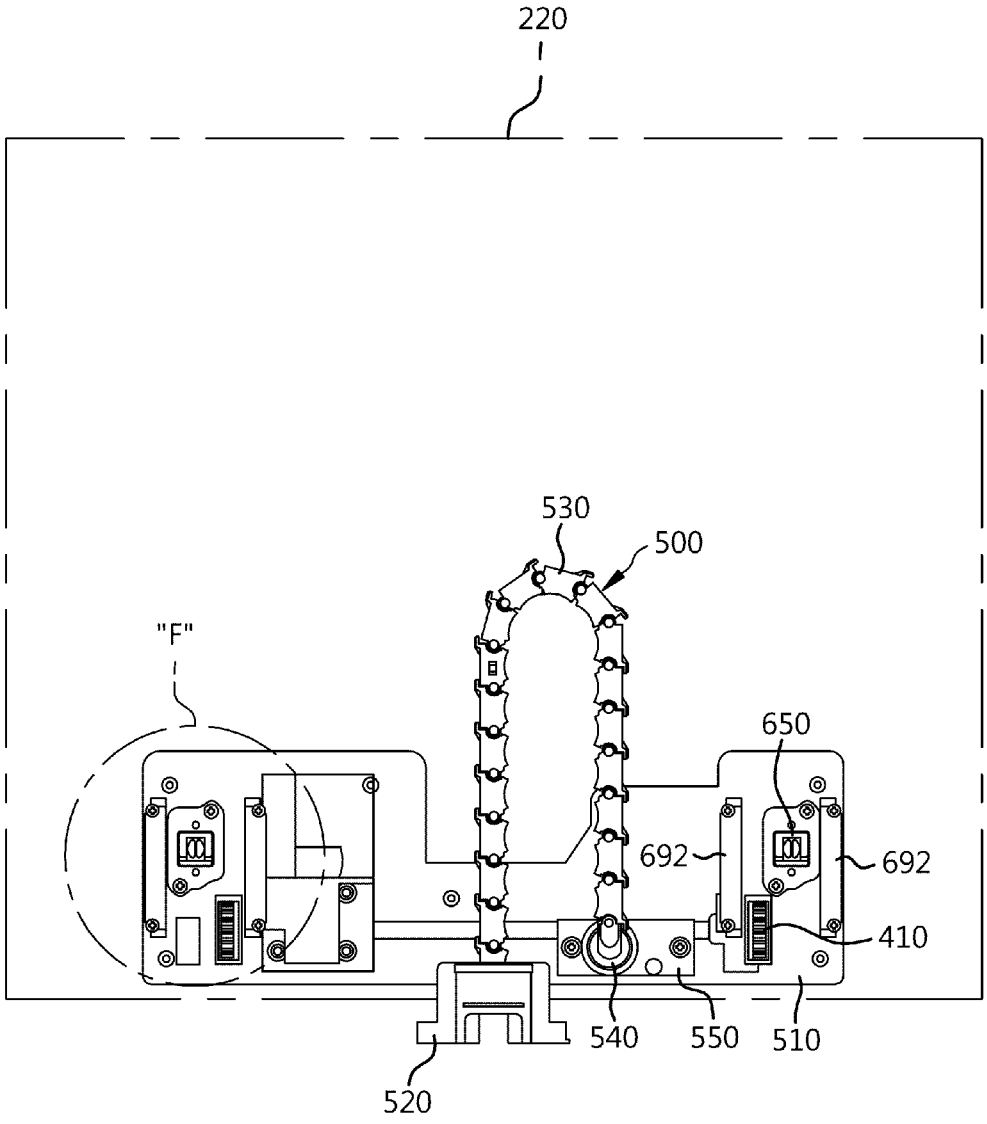
FIG. 22 is a top plan view illustrating a state of an inner part of a lower storage chamber of the refrigerator according to the embodiment of the present disclosure.
Figure 23:
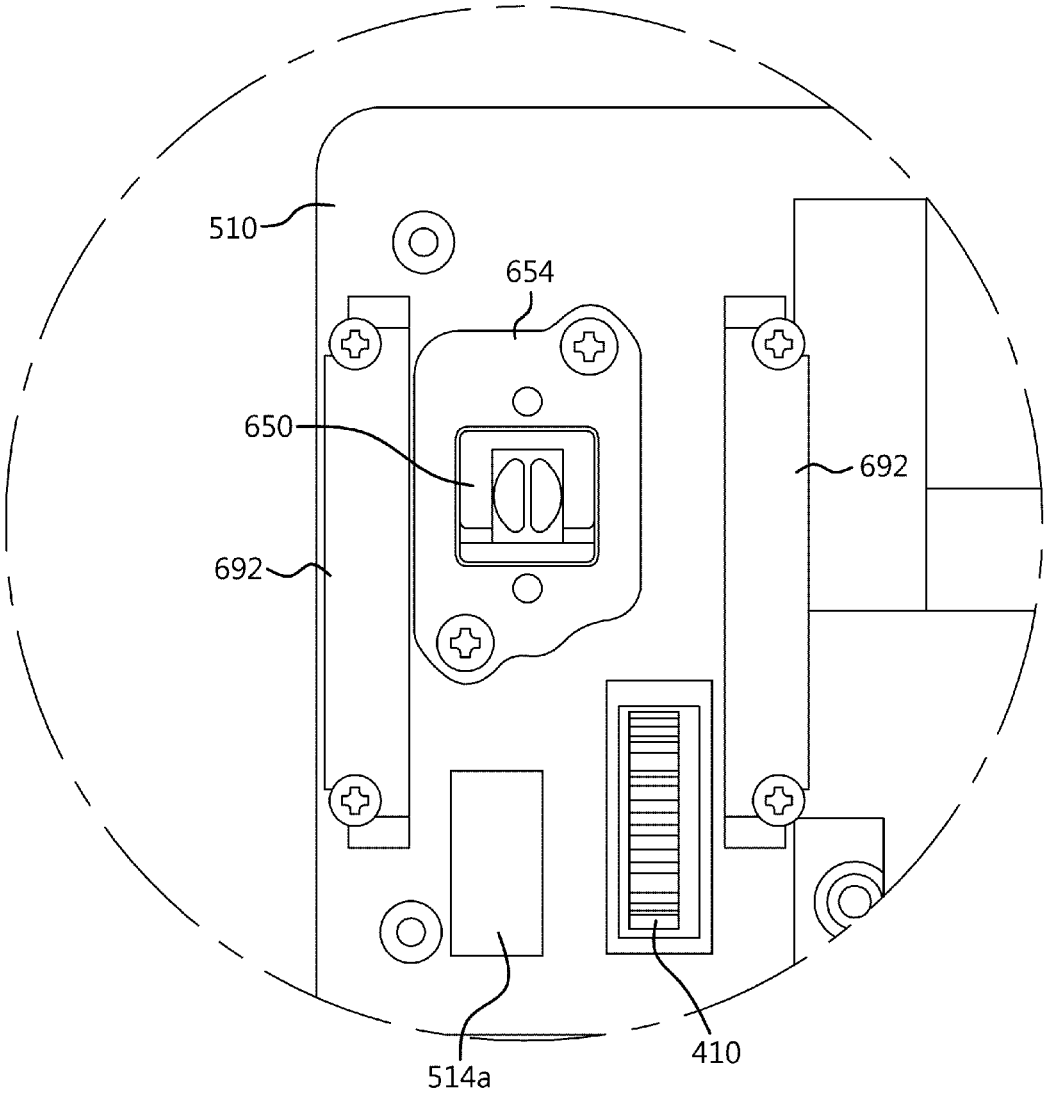
FIG. 23 is an enlarged view of an "F" portion of FIG. 22.
Figure 24:
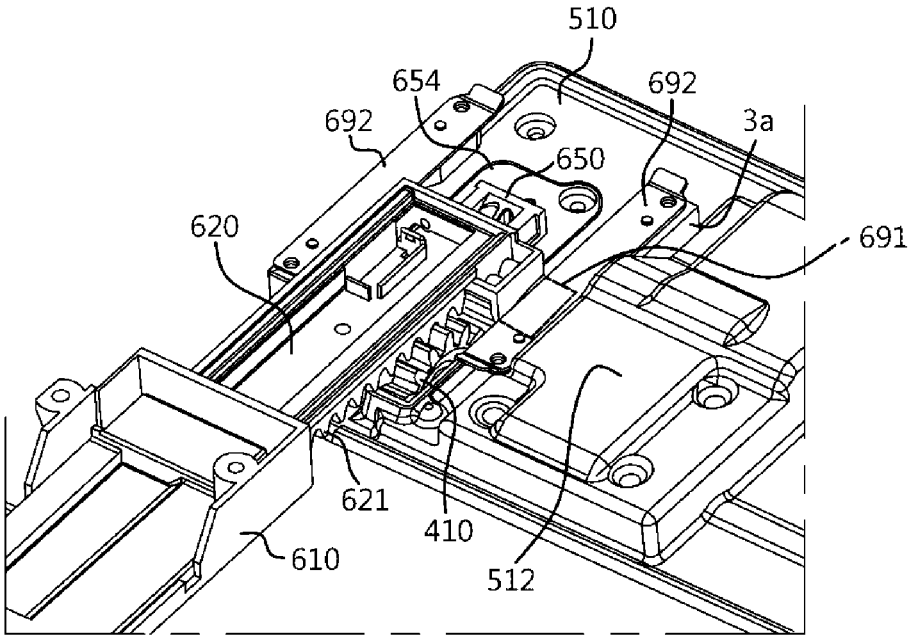
FIG. 24 is a perspective view of an important part illustrating a state in which a wing end of the refrigerator according to the embodiment of the present disclosure is pressed by a blocking plate.
Figure 25:
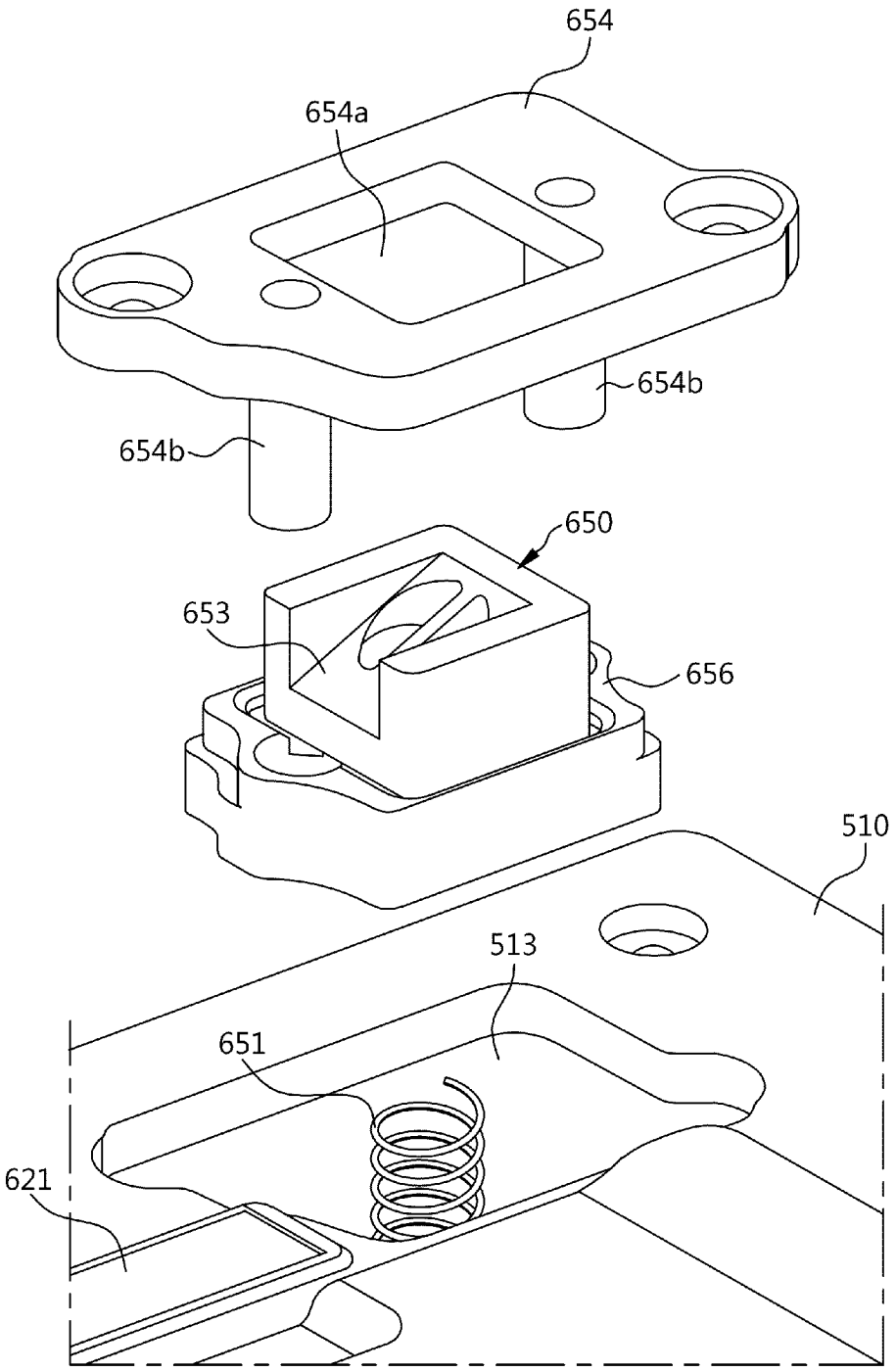
FIG. 25 is an exploded perspective view illustrating a confining protrusion part of the refrigerator according to the embodiment of the present disclosure.

For example, one or more wing ends 691 to protrude outward from opposite sides of a rear end of the second rack member 620 (See FIGS. 13, 15, 17, and 18), and a blocking part (or blocking plate) 692 may be provided on a bottom surface (an upper surface of the bottom) of the inner part of the lower storage chamber 3 to contact the wing ends 691 and block an upward movement of each of the wing ends 691 (See FIGS. 21 to 23). Accordingly, the rack gear 621 of the second rack member 620 may remain properly engaged with the pinion 410 while moving back and forth. As illustrated in the drawings, according to certain embodiments, the blocking part 692 may be fixed to the cover plate 510 of the cable guide module 500 provided on the bottom surface of the inner part of the lower storage chamber 3.

The blocking part 692 may be a metal plate having a length ranging from a positioning portion of the pinion 410 to a rear side of the pinion 410, and may be configured to be engaged with and fixed to a fixing step 3*a* (See FIG. 24) protruding from the bottom surface (or the upper surface of the cover plate 510) of the inner part of the lower storage chamber 3.

Figure 18:
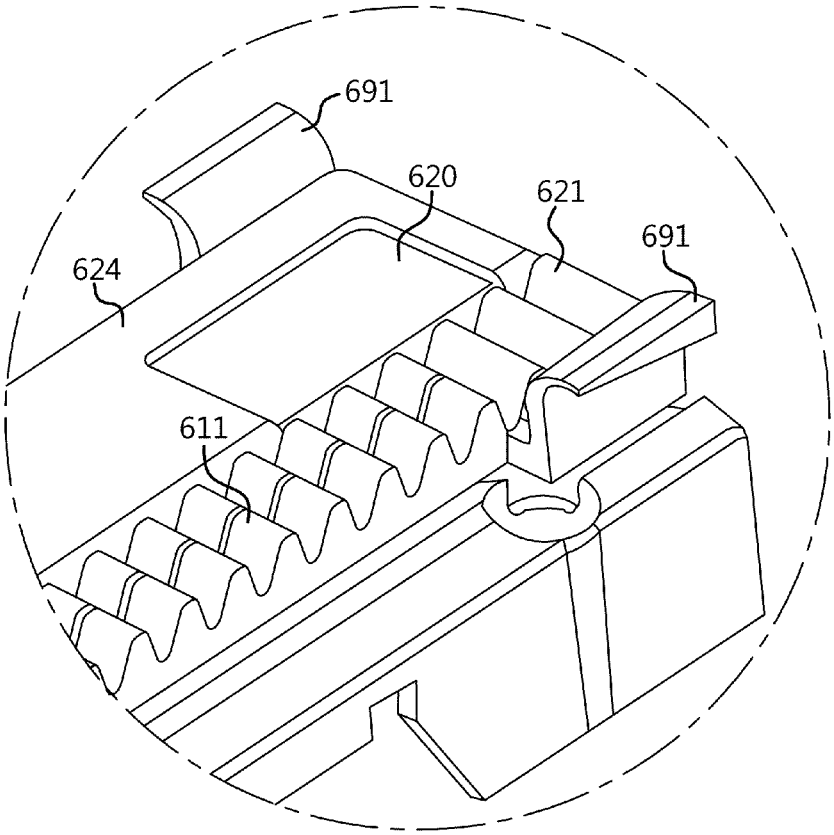
FIG. 18 is an enlarged view of a "C" portion of FIG. 17.
Figure 19:
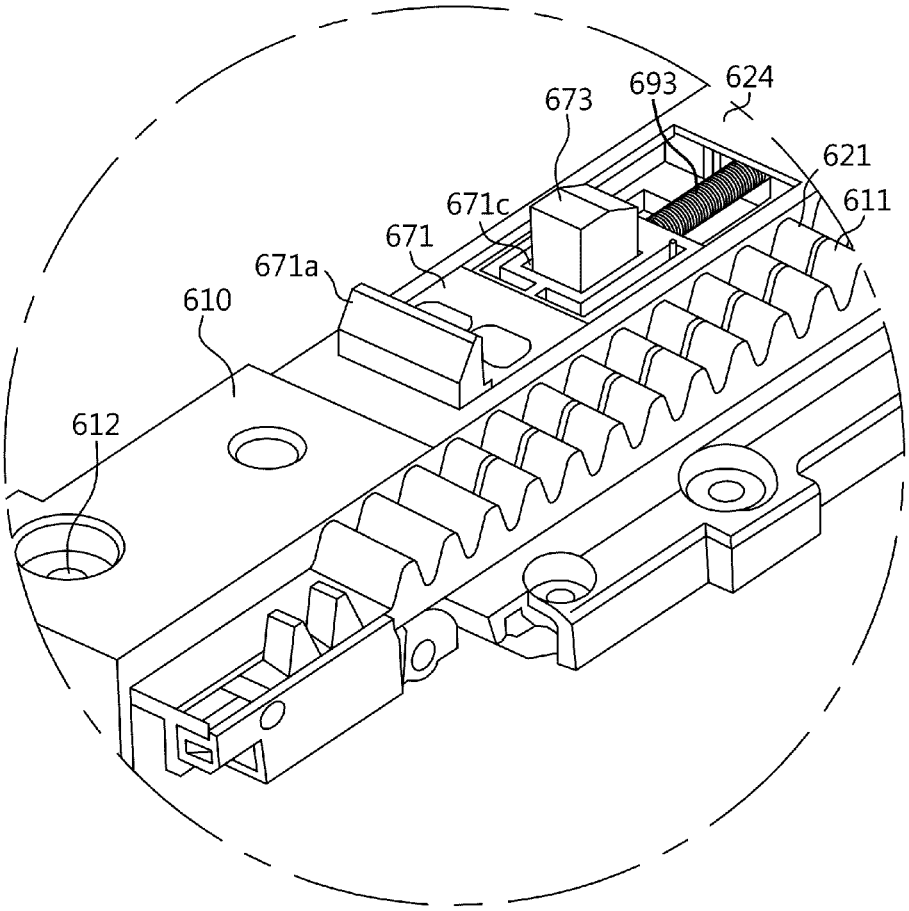
FIG. 19 is an enlarged view of a "D" portion of FIG. 17.
Figure 20:
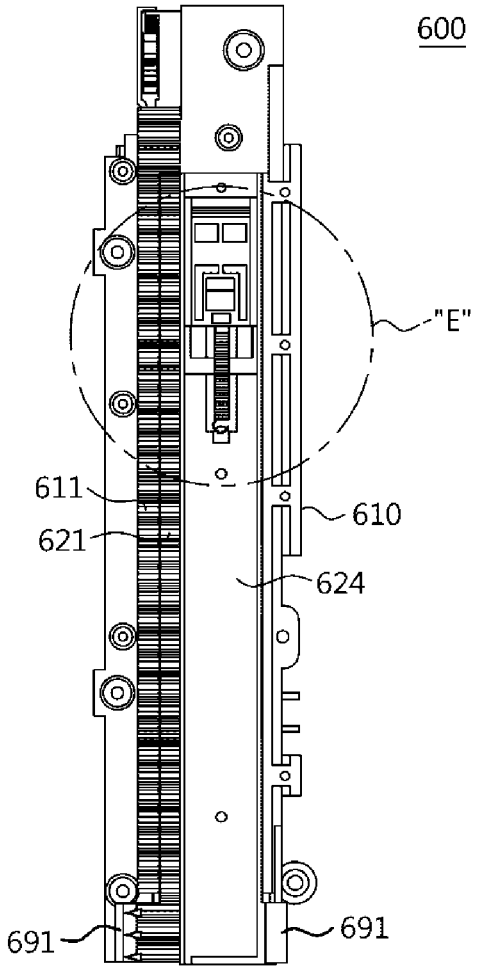
FIG. 20 is a bottom view illustrating a structure of the lower surface of the rack gear assembly of the refrigerator according to the embodiment of the present disclosure.

An upper surface of the wing end 691 may be configured to be gradually inclined upward or round toward a rear thereof, and a rear end of the blocking part 692 may be configured to be gradually inclined upward or round toward a rear thereof (See FIG. 18). Due to such a structure, the wing end 691 may be efficiently inserted into a lower part of the blocking part 692 during the forward movement of the second rack member 620. Furthermore, since a front end of the blocking part 692 may be gradually inclined upward or round toward a front thereof, the storage bin 220, to which the rack gear assembly 600 is initially mounted, may be guided by the blocking part 692 to be easily received in the lower storage chamber 3.

The confining module 670 may confine the second rack member 620 until the first rack member 610 is completely extended. The confining module 670 may include the confining protrusion part (or confining protrusion) 650 (see FIGS. 23-27), the stopper member (or stopper plate) 671, the holder 672, and the locking member (or stopping extension) 673.

The confining protrusion part 650 may include an upper surface of which is closed and a lower surface of which is open and may be provided at a front of the upper surface of the bottom 120 included in the cabinet 100. For example, the confining protrusion part 650 may be installed in the protrusion passing hole 513 formed through the cover plate 510. In another example, the cover plate 510 may be omitted, and the confining protrusion part 650 may be installed on an upper surface of the bottom 120 of the cabinet 100.

The confining protrusion part 650 may be installed to be elastically lifted in the protrusion passing hole 513 by an elastic member 651 that provides an upward elastic force. The confining protrusion part 650 may be configured to protrude to the inner part of the lower storage chamber 3 from the protrusion passing hole 513 when the confining protrusion part 650 is not pressed downward. In some examples, the elastic member 651 may be a coil spring, and an upper end of the elastic member 651 may be coupled to a spring engagement protrusion 652 in the confining protrusion part 650 by passing through a lower surface of the confining protrusion part 650, as illustrated in FIGS. 25, 27, 29, and 31.

A slope (or sloped surface) 653 may be provided at a middle of an upper surface of the confining protrusion part 650. The slope 653 may be gradually inclined upward toward a rear of the confining protrusion part 650 from a front thereof. As the locking member 673 of the confining module 670 moves backward on the slope 653, the confining protrusion part 650 may be configured to move downward.

A lower end of the confining protrusion part 650 may be extended compared to the remaining portions thereof, and a confining holder (or plate) 654 may be provided on an outer surface of an upper side of the confining protrusion part 650 so as to block the extended portion of the confining protrusion part 650. The confining holder 654 may be fixed to the cover plate 510 to prevent deviation of the confining protrusion part 650. The confining protrusion part 650 may be positioned behind the pinion 410 or may be positioned to be maximally adjacent to the pinion 410.

The stopper member 671 may be provided in the motion groove 622 of the second rack member 620 and may restrict a backward movement of the second rack member 620. A length of the stopper member 671 from a front of the stopper member 671 to a rear thereof may be shorter than a length of the motion groove 622 from a front of the motion groove 622 to a rear thereof. Accordingly, the stopper member 671 may be installed to slide to move in forward and backward directions in the motion groove 622.

In addition, a confining hook 671*a* may be provided on a lower surface of the front end of the stopper member 671 and may protrude downward therefrom. In this case, when the drawer 200 is moved backward by a predetermined distance, the confining hook 671*a* may hit the front surface of the confining protrusion part 650 such that the stopper member 671 and the first rack member 610 are not moved backward any further.

In addition, a holder groove 671*b* may be provided on an upper surface of the front of the stopper member 671, and a locking member through hole 671*c* may be provided on a rear portion of the stopper member 671. For example, the locking member through hole 671*c* may be vertically formed through the rear portion of the stopper member 671.

The holder groove 671*b* may gradually incline downward toward a rear thereof. For example, when the holder 672 is received into the holder groove 671*b* and moves forward, the holder 672 can move away from the holder groove 671*b*.

The holder 672 may restrict forward and backward movements of the stopper member 671. A lower end of the holder 672 may be received into the holder groove 671*b* of the stopper member 671, and an upper end of the holder 672 may pass through the first through hole 622*a* of the second rack member. When the first rack member 610 moves forward by a predetermined distance and pulls the second rack member 620, the holder 672 may escape from the holder groove 671*b* while moving forward together with the second rack member 620 and may be received into the first receiving groove 614*a* of the first rack cover 614.

In some implementations, each of a front upper edge of the holder 672 and a front lower edge may be inclined. The inclination of the front lower edge of the holder 672 may corresponds to the inclination of the holder groove 671*b*. Accordingly, the holder 672 may efficiently escape from the holder groove 671*b*.

The holder 672 may include a cut groove 672*a* provided in an upper surface thereof and extended in forward and backward directions. An insert protrusion 614*c* received into the cut groove 672*a* may be provided on a lower surface of the first rack cover 614 facing the upper surface of the holder 672. For example, the insert protrusion 614*c* may be provided from a front end of the first rack cover 614 to extend into an interior of the first receiving groove 614*a*. Due to a structure of the cut groove 672*a* and the insert protrusion 614*c*, while the first rack member 610 moves, leftward and rightward movements of the holder 672 are prevented such that the insert protrusion 614*c* may be accurately received into the first receiving groove 614*a*. In some examples, multiple pairs of the cut groove 672*a* and the insert protrusion 614*c* may be provided.

The locking member 673 may be positioned at a rear of the confining protrusion part 650 and may be held by the confining protrusion part 650 until the first rack member 610 is moved forward by a predetermined distance to prevent a forward movement of the second rack member 620. When the second rack member 620 and the second rack cover 624 move together with the first rack member 610 and the first rack cover 614 by the predetermined distance, the locking member 673 may move upward and may be received in the second receiving groove 614*b* of the first rack cover 614 that is positioned to correspond to an upper part of the locking member 673. Accordingly, the locking member 673 confined by the confining protrusion part 650 may be released due to the motion of the movement of first rack member 610.

An extending step 673*a* may be provided at an upper end of the locking member 673, such as to extend to opposite sides thereof, and lifting guide steps 623 (see FIG. 14) having a round (or inclined) shape may be provided at opposite sides of the second through hole 622*b* on an upper surface of the front end of the second rack member 620. The extending step 673*a* may be lifted while the first rack member 610 and the first rack cover 614 are moved forward by a predetermined distance and move together with the second rack member 620 and the second rack cover 624.

For example, when the first rack member 610 and the first rack cover 614 are moved forward by a predetermined distance and move together with the second rack member 620 and the second rack cover 624, the lifting guide step 623 in the second rack member 620 may allow the extending step 673*a* of the locking member 673 to be lifted. Accordingly, the locking member 673 may move upward to a height at which the locking member 673 does not contact the confining protrusion part 650.

The lifting guide step 623 may be gradually inclined or rounded upward toward a rear thereof. For example, the lifting guide step 623 may be gradually incline upward toward a rear of the second through hole 622*b* from a middle portion of each of opposite sides thereof. When the locking member 673 is positioned at the front of the second through hole 622*b*, the locking member 673 may not be influenced by the lifting guide step 623. As the locking member 673 is moved to the rear of the second through hole 622*b* by a forward movement of the second rack member 620, the locking member 673 may be influenced by the lifting guide step 623 and may be gradually moved upward.

In certain implementations, the extending step 673*a* of the locking member 673 may be configured to have a round or inclined shape correspond to a shape of a corresponding surface of the lifting guide step 623. In addition, a lower surface of the locking member 673 may gradually incline upward toward a rear thereof. Inclination of the lower surface of the locking member 673 may correspond to the inclination of the slope 653 provided at the middle of the upper surface of the confining protrusion part 650.

In certain embodiments, the locking member 673 of the confining module 670 may position the extending step 673*a* to climb on and maintain contact with the lifting guide step 623 when the second rack member 620 is moving in cooperation with the first rack member 610. For example, when the extending step 673*a* of the locking member 673 does not maintain contact with the lifting guide step 623 and slides downward on the lifting guide step 623 forward along inclination thereof, the first rack member 610 may move backward from the second rack member 620 and the drawer 200 may close.

In an embodiment, a confining member (or confining spring) 693 may be provided to maintain the locking member 673 in an upward extended, confined state until the second rack member 620 completes a backward movement. The confining member 693 may be positioned between a wall surface of a moving direction side of the stopper member 671 and the motion groove 622 opposed thereto to confine the stopper member 671 such that the stopper member 671 may be maintain in a position at a rear side of an inner part of the motion groove 622. Accordingly, a forward movement of the locking member 673 may be also prevented by the confined stopper member 671, so that the extending step 673*a* may be maintained in engagement with the lifting guide step 623.

In certain configurations, the confining member 693 may be a coil spring. For example, a first end of the confining member 693 may be to a rear surface of the stopper member 671 and a second end confining member 693 may be connected to a rear side of the motion groove 622 of the second rack member 620, as illustrated in FIGS. 26 to 31.

Figure 27:
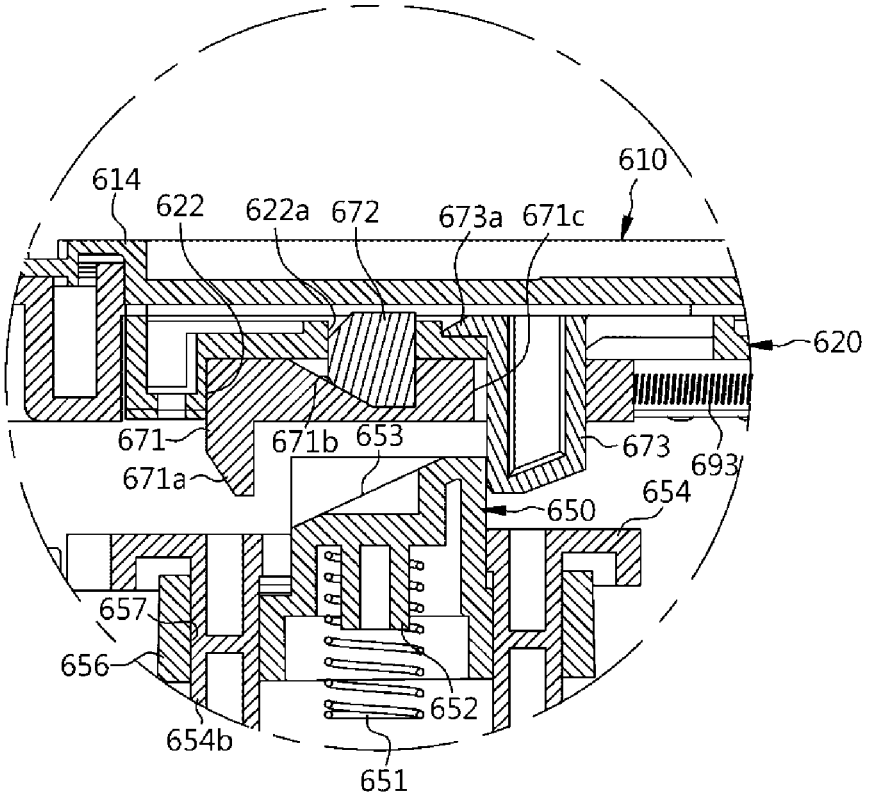
FIG. 27 is an enlarged view of a "G" portion of FIG. 26.

Hereinbelow, operation of the refrigerator according to the embodiment of the present disclosure will be described with respect to FIGS. 26 to 32. When the drawer 200 is not manipulated, the drawer 200 may be maintained in a closed state, as shown in FIGS. 26 and 27. While the drawer 200 is in the closed state and an input to open the drawer 200 is performed, power may be supplied to the driving part 400, and the driving motor 420 may operate. For example, the input to open the drawer 200 may include a user manipulation of a button 6 (e.g., a touching or pressing type button). Alternatively, a controller may control the drawer to open based on detecting a proximity of a user.

When the driving motor 420 is operated, the pinions 410 may be simultaneously rotated due to the driving force from the motor 420. The rack gears 611 and 621 of the rack gear assemblies 600 engaged with the opposite pinions 410 may be operated based on the rotation of the pinions 400, and the drawer 200 is moved forward.

After the first rack member 610 and the first rack cover 614 are first moved forward simultaneously, the second rack member 620 and the second rack cover 624 may be moved forward. While the first rack member 610 and the first rack cover 614 are moved forward simultaneously, the locking member 673 may be confined by the confining protrusion part 650. Accordingly, the second rack member 620 and the second rack cover 624 maintain initial positions thereof.

Figure 29:
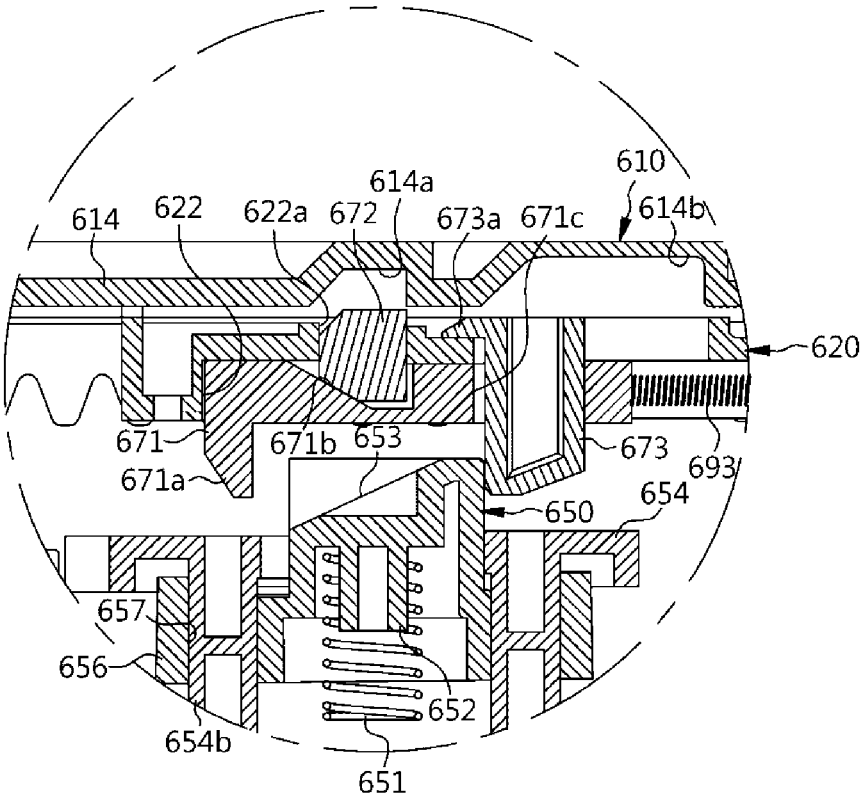
FIG. 29 is an enlarged view of an "H" portion of FIG. 28.

When the first rack member 610 and the first rack cover 614 are moved forward by a preset first distance and the linkage protrusion 681 comes into contact with the linkage step 682, the second rack member 620 and the second rack cover 624 may move forward together with the first rack member 610 from the contact of the linkage protrusion 681 with the linkage step 682, as shown in FIGS. 28 and 29.

Figure 30:
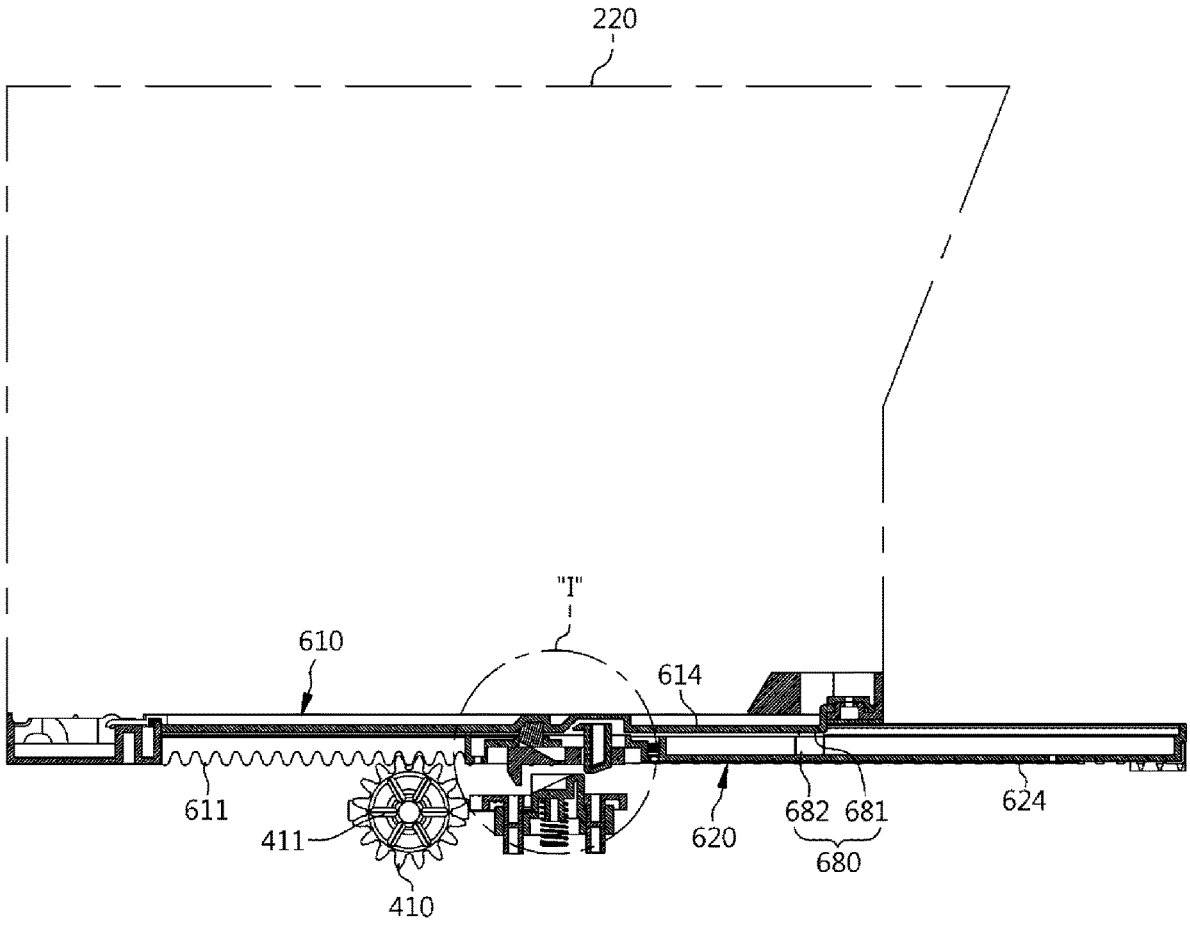
Figure 31:
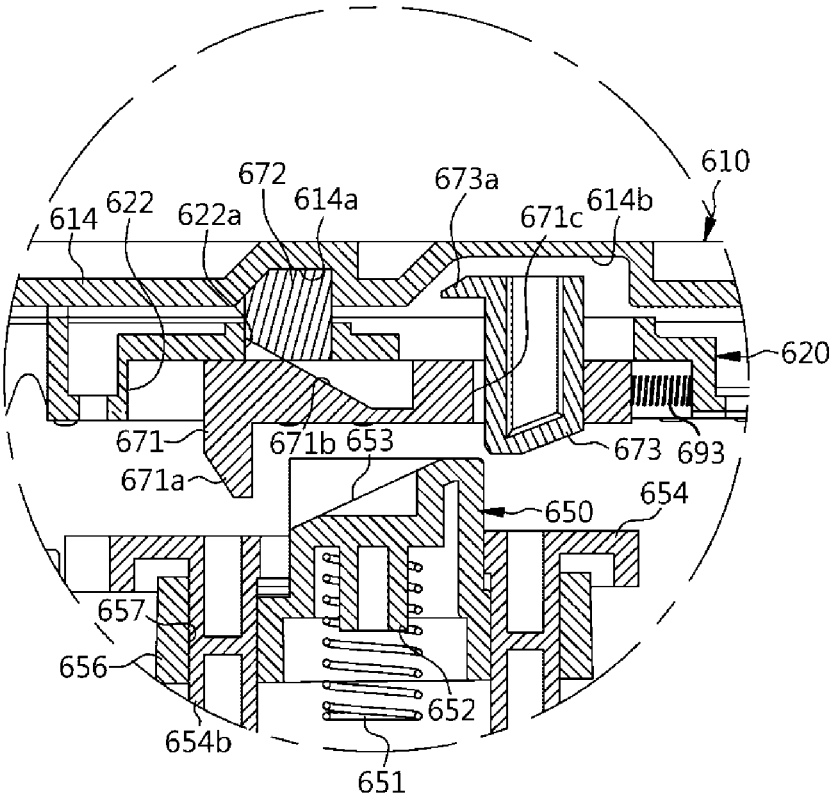
FIG. 31 is an enlarged view of an "I" portion of FIG. 30.

Since the locking member 673 is confined by the confining protrusion part 650, the stopper member 671 through which the locking member 673 passes maintains an initial position, and the second rack member 620 moves forward. As the extending step 673*a* of the locking member 673 gradually climbs on the lifting guide step 623 provided in the second rack member 620, the locking member 673 moves upward and moves away from the confining protrusion part 650, as shown in FIGS. 30 and 31.

Figure 32:
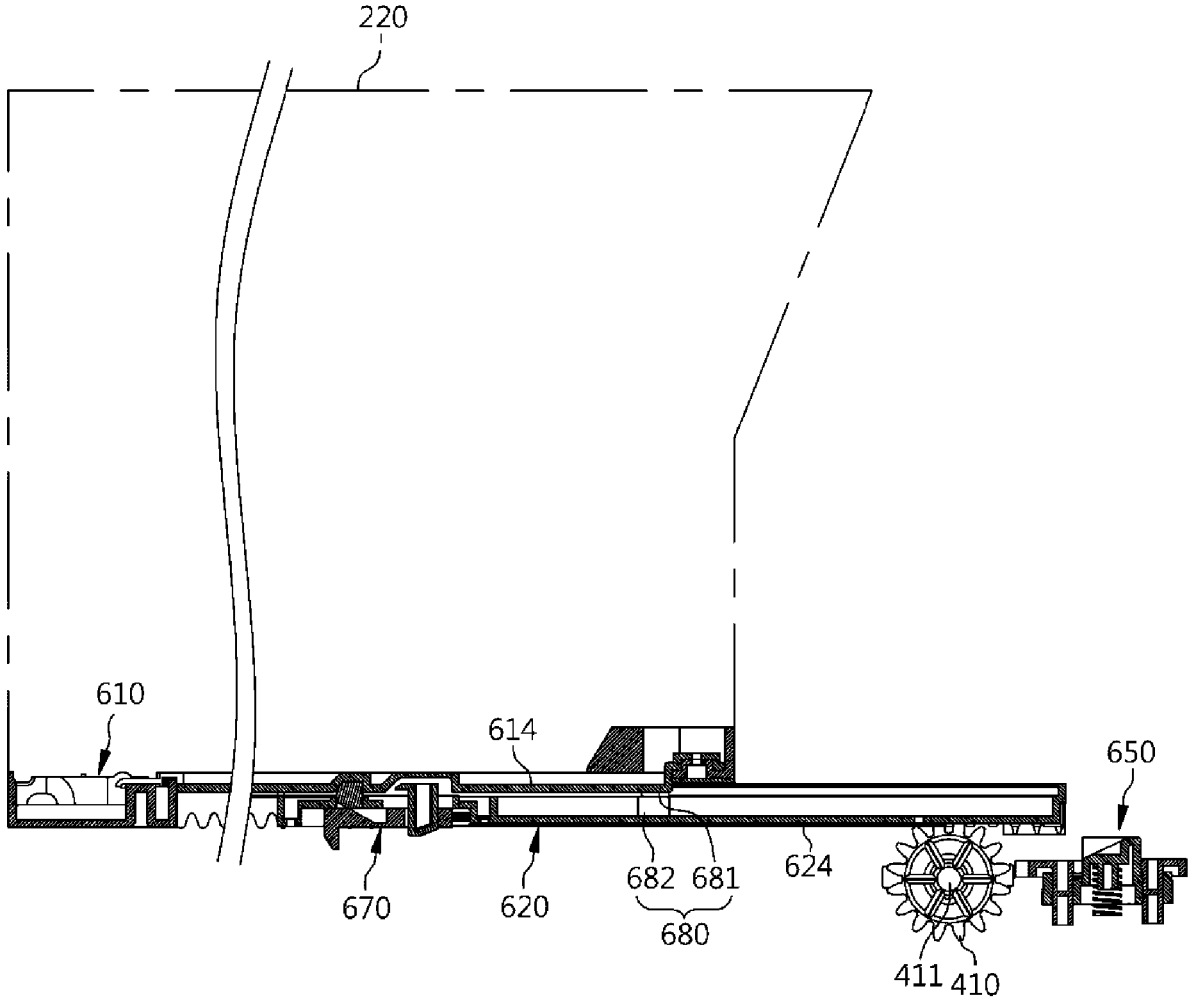

As the stopper member 671 moves forward together with the second rack member 620 while the stopper member 671 contacts an inner rear surface of the motion groove 622, the stopper member 671 passes the confining protrusion part 650. Subsequently, when the second rack member 620 and the second rack cover 624 move to follow the first rack member 610 and the first rack cover 614, the rack gear 621 of the second rack member 620 may engage the pinion 410 as the rack gear 611 of the first rack member 610 moves away from the pinion 410. When the rack gear 611 of the first rack member 610 moves away from the pinion 410 and the rack gear 621 of the second rack member 620 engages the pinion 410, the rack gear 621 receives a driving force from the pinion 410 so as to further move the drawer 200 forward, as shown in FIG. 32.

When the forward movement of the second rack member 620 is completed, as described above, the storage bin 220 of the drawer 200 may be positioned at a maximum open state. When a maximum open state of the storage bin 220 is detected (for example, detected by the open/close sensing part 514*a*, 514*b*), the lift module 300 may operate to move the container 240 in the storage bin 220 upward so that a user can efficiently take out the container 240 or items stored in the container 240 or store items into the container 240.

When an input to close the drawer 200 is received after the user has completed the use of the drawer 200, the driving motor 420 include in the driving part 400 operates and the pinion 410 may rotate in closing direction (e.g., counterclockwise). Accordingly, the rack gear 621 of the second rack member 620 engaged with the pinion 410 operates and moves the second rack member 620 backward. The first rack member 610 may be pulled by the second rack member 620 due to the linkage part 680, and the first rack member 610 may move backward together with the second rack member 620.

When the front end of the rack gear 621 of the second rack member 620 is positioned to be engaged with the pinion 410, the rear end of the rack gear 611 of the first rack member 610 may also be positioned to engage the pinion 410. Subsequently, as the rack gear 621 of the second rack member 620 completes a rear movement and moves away from and no longer contacts the teeth of the pinion 410, and the first rack member 610 continues to move backward as the rack gear 611 engages the pinion 410.

For example, as described above, immediately before the second rack member 620 completely moves backward, the confining hook 671*a* of the stopper member 671 may engage the confining protrusion part 650 and does not move backward any further. While the stopper member 671 is blocked and the second rack member 620 additionally moves by a distance by which the stopper member 671 is provided to move in the motion groove 622, the extending step 673*a* of the locking member 673 is removed from the lifting guide step 623, and the locking member 673 moves downward.

When the second rack member 620 is prevented from moving further backward by the stopper member 671, the confining protrusion part 650 is positioned between the confining hook 671*a* of the stopper member 671 and the locking member 673 and engages to confine the second rack member 620. The first rack member 610 continues to move backward until the first rack member 610 returns to an initial position thereof (e.g., a position at which the storage bin is completely received). When completion of such a restoring movement is detected, the operation of the driving motor stops and the closing movement of the drawer stops.

When the rack gear 621 of the second rack member 620 is moved by being engaged with the pinion 410 while the opening or closing of the drawer 200 due to the above-described movement is performed, the one or more wing ends 691 provided at opposite sides of a rear end of the second rack member 620 may be prevented from being moved upward while passing a lower part of the blocking plate 692 positioned on a bottom of the lower storage chamber 3. Accordingly, although a weight of the storage bin 220 may apply a downward force to the first rack member 610, engagement of the second rack member 620 with the pinion 410 may be maintained due to the wing ends 691 at the rear end of the second rack member 620 contacting the blocking plate 692.

In addition, while the second rack member 620 is moved forward or when the second rack member 620 is completely moved forward, the stopper member 671 is maintained at position at a rear side of an inner part of the motion groove 622 by the confining member 693. Accordingly, the locking member 673 may be prevented from being moved forward, and the extending step 673*a* may be maintained in contact with the lifting guide step 623. Thus, when an impact or shaking occurs, the extending step 673*a* of the locking member 673 may be prevented from deviating from the lifting guide step 623 such that an unwanted backward movement of the first rack member 610 may be prevented.

Accordingly, the refrigerator of the present disclosure includes the rack gear assembly 600 that is configured to extend sequentially such that the storage bin 220 of the drawer 200 may be completely opened. For example, the storage bin 220 may be configured to be opened and closed by being guided by a guide rail 230 provided at opposite sides thereof, and a lower part of the storage bin may be moved while being supported by the rack gear assembly 600. Accordingly, although the storage bin is heavy, an operation malfunction of the storage bin 220 may be prevented.

Furthermore, according to the refrigerator of the present disclosure, the first rack member 610 of the rack gear assembly 600 may be fixed to a lower surface of the storage room, and a second rack member 620 of the rack gear assembly 600 may slidably move in the first rack member 610. Accordingly, a width of the rack gear assembly 600 is minimized.

In addition, according to the refrigerator of the present disclosure, the linkage part 680 may be provided at an opposing portion of the first rack member 610 and the second rack member 620 to allow the second rack member 620 to move forward in cooperation with the first rack member when the first rack member 610 is moved forward by a predetermined distance. Furthermore, the movement guiding groove 613 may be formed through a rear surface of the first rack member 610 from a front end portion of a lower surface of the first rack member 610 such that the second rack member may be exposed to the rear of the movement guiding groove 613 to allow the second rack member 620 to move stably. Additionally, according to the refrigerator of the present disclosure, each of the rack gear 611 of the first rack member 610 and the rack gear 621 of the second rack member 620 may be sequentially engaged with the pinion 410 so that an exact sequential movement of each rack member is performed.

In addition, according to the refrigerator of the present disclosure, the wing end 691 may be provided at each of opposite sides of a rear end of the second rack member 620 by protruding to the outside, and the blocking part 692 may be provided on a bottom surface of the inner part of the lower storage chamber 3 to block the upward movement of each of the wing ends 691. Accordingly, the rack gear 621 of the second rack member 620 may be prevented from being spaced apart from deviating from the pinion 410.

Furthermore, according to the refrigerator of the present disclosure, the blocking part 692 is made of a metal plate having a length ranging from a positioning portion of the pinion 410 to a rear side of the pinion 410 so that the blocking part may stably support each of the wing ends 691. In addition, each of the wing ends 691 may be gradually inclined upward or rounded backward, and a rear end of the blocking part 692 may also be gradually inclined upward or rounded backward, so that each of the wing ends 691 may be is efficiently positioned in a lower surface of the blocking part 692.

In addition, according to the refrigerator of the present disclosure, the confining module 670 may include the confining protrusion part 650 and the locking member 673 so that the second rack member is not moved until the first rack member 610 is moved forward by a predetermined distance. While the second rack member 620 is moved forward, the locking member 673 may efficiently move from the confining protrusion part 650 due to the lifting guide step 623 provided in the second rack member and the extending step 673*a* provided in the locking member 673.

In addition, according to the refrigerator of the present disclosure, a backward movement of the second rack member 620 may be limited by the provided the stopper member 671. Additionally, the holder 672 may confine the stopper member 671 until the locking member 673 escapes from the confining protrusion part 650. Furthermore, the holder 672 may be exposed to an upper part of the second rack member 620 by passing therethrough so that the holder 672 moves away from the stopper member 671 at the same time when the second rack member 620 is moved.

In addition, since a distance defined between a rear surface of the first receiving groove 614*a* and a rear surface of the second receiving groove 614*b* is longer than a distance defined between a rear surface of the holder 672 and a rear surface of the locking member 673, the holder 672 and the locking member 673 may be sequentially operated.

Additionally, an upper surface of the first rack member 610 may be replaced with the first rack cover 614 to make manufacturing thereof easier. In addition, according to the refrigerator of the present disclosure, the second rack member 620 properly follows the first rack member 610 due to the linkage part 680.

Furthermore, according to the refrigerator of the present disclosure, the stopper member 671 may move forward and backward in the second rack member 620. Accordingly, the extending step 673*a* of the locking member 673 may climb on the lifting guide step 623.

Additionally, according to the refrigerator of the present disclosure, the confining member 693 is provided to limit an unintended backward movement of the first rack member. In addition, according to the refrigerator of the present disclosure, the confining member 693 may be a coil spring that is relatively east to manufacture.

Furthermore, according to the refrigerator of the present disclosure, a backward moving distance of the second rack member 620 may be controlled by the confining hook 671*a* of the stopper member 671. In addition, according to the refrigerator of the present disclosure, the second rack cover 624 may be a metal plate such that a twisting or deformation of the second rack member 620 can be minimized.

Accordingly, aspects of the present disclosure provide a refrigerator in which an opening distance of a drawer is maximized such that items stored in a storage bin are easily stored or taken out. Furthermore, aspects of the present disclosure further provide a refrigerator in which a more exact engagement of a pinion with a guide rack is maintained irrespective of various external factors such as downward bending or operational vibration of the storage bin which may occur by weight of items stored in the storage room.

Furthermore, aspects of the present disclosure provide a refrigerator in which an operational malfunction of the drawer while the drawer is moved forward is prevented. Additionally, aspects of the present disclosure provide a refrigerator in which, when the drawer is completely moved forward, unwanted movement of the drawer in a closing direction may be prevented.

In order to achieve the above described aspects, the refrigerator of the present disclosure may include a rack gear assembly configured to extend sequentially such that the storage bin constituting a drawer may be completely opened. The storage bin may be configured to be opened and closed by being guided by a guide rail provided at opposite sides thereof, and a lower part of the storage bin is moved with the lower part supported by the rack gear assembly. Accordingly, although the storage bin may be heavy, operation malfunction of the storage bin may be prevented.

Furthermore, a first rack member of the rack gear assembly may be fixed to a lower surface of the storage bin and a second rack member of the rack gear assembly may be provided to slidably move in the first rack member, such that a width of the rack gear assembly may be minimized.

In addition, a linkage part may be provided at an opposing portion of the first rack member and the second rack member to allow the second rack member to move forward in cooperation with the first rack member when the first rack member is moved forward by a predetermined distance. Accordingly, the two rack members may be allowed to properly operate in cooperation with each other.

Furthermore, a movement guiding groove may be configured to be formed through a rear surface of the first rack member from a front end portion of a lower surface of the first rack member such that the second rack member is exposed to the rear of the movement guiding groove. Accordingly, a stability of a movement of the second rack member may be improved. Additionally, each of the rack gear of the first rack member and the rack gear of the second rack member may be provided to be sequentially engaged with the pinion, so that an exact sequential movement of each rack member may be performed.

In addition, a wing end may be provided at each of opposite sides of a rear end of the second rack member by protruding to the outside, and a blocking part may be provided on a bottom surface of an inner part of the storage chamber to block an upward movement of each of the wing ends. Accordingly, the rack gear of the second rack member may be prevented from deviating from the pinion. Furthermore, the blocking part may be made of a metal plate having a length ranging from a positioning portion of the pinion to a rear side of the pinion so that the blocking part may stably support each of the wing ends. In addition, each of the wing ends may be configured to be gradually inclined upward or round toward a rear thereof, and a rear end of the blocking part may be configured to be gradually inclined upward or round toward a rear thereof, so that each of the wing ends may be efficiently positioned in a lower part of the blocking part.

In addition, the refrigerator may include a confining module that includes a confining protrusion part and a locking member. The second rack member may not be moved until the first rack member is moved forward by a predetermined distance. Furthermore, a lifting guide step may be provided in the second rack member, and an extending step may be provided in the locking member so that when the second rack member is moved forward, the locking member efficiently may escape from the confining protrusion part. The refrigerator may further include a stopper member to limit a backward movement of the second rack member to a predetermined position.

Additionally, the refrigerator of the present disclosure may include a holder that confines the stopper member until the locking member escapes from the confining protrusion part. The holder may be configured to be exposed to an upper part of the second rack member by passing therethrough, and the holder may move away from the stopper member at the same time when the second rack member is moved.

In addition, a distance defined between a rear surface of a first receiving groove and a rear surface of a second receiving groove may be longer than a distance defined between a rear surface of the holder and a rear surface of the locking member so that the holder and the locking member may be sequentially operated.

Additionally, an upper surface of the first rack member may be replaced with a first rack cover to allow for easier manufacturing. In addition, the refrigerator may include a linkage part that allows the second rack member to properly follow the first rack member.

Furthermore, the refrigerator may include a stopper member to move forward and backward in the second rack member so that an extending step of the locking member may properly climb on the lifting guide step. Additionally, the refrigerator may include a confining member to prevent an unwanted backward movement of the first rack member. For example, the confining member may a coil spring. Furthermore, the refrigerator may include a confining hook of the stopper member to limit a backward moving distance of the second rack member. In addition, a second rack cover may be a metal plate that helps to prevent a twisting or a deformation of the second rack member.

According to the refrigerator of the present disclosure, the storage bin constituting the drawer may be completely opened by the rack gear assembly configured to extend sequentially. The storage bin is configured to be opened and closed by being guided by a guide rail provided at each of opposite sides thereof, and a lower part of the storage bin is moved with the lower part supported by the rack gear assembly. Accordingly, although the storage bin is heavy, operation malfunction of the storage bin is prevented.

Furthermore, the first rack member of the rack gear assembly may be fixed to a lower surface of the storage room, and the second rack member of the rack gear assembly is provided to slidably move in the first rack member. Accordingly, a width of the rack gear assembly is minimized.

In addition, the linkage part may be provided at an opposing portion of the first rack member and the second rack member to allow the second rack member to move forward in cooperation with the first rack member when the first rack member is moved by a predetermined distance. Accordingly, the two rack members are allowed to properly operate in cooperation with each other. Furthermore, a movement guiding groove is configured to be formed through a rear surface of the first rack member from a front end portion of a lower surface of the first rack member such that the second rack member is exposed to the rear of the movement guiding groove so that a movement of the second rack member is stable. Additionally, each of the rack gear of the first rack member and the rack gear of the second rack member may be sequentially engaged with the pinion so that an exact sequential movement of each rack member is performed.

In addition, a wing end is provided at each of opposite sides of a rear end of the second rack member by protruding to the outside, and a blocking part may be provided on a bottom surface of an inner part of the storage chamber to block the upward movement of each of the wing ends so that the rack gear of the second rack member may be prevented from deviating from the pinion. Furthermore, the blocking part is made of a metal plate having a length ranging from a positioning portion of the pinion to a rear side of the pinion so that the blocking part stably supports each of the wing ends. In addition, each of the wing ends is configured to be gradually inclined upward or round toward a rear thereof, and a rear end of the blocking part is configured to be gradually inclined upward or round toward a rear thereof so that each of the wing ends may be efficiently positioned in the lower part of the blocking part.

In addition, the refrigerator may include a confining module that includes the confining protrusion part and the locking member so that the second rack member is not moved until the first rack member is moved forward by a predetermined distance. When the second rack member is moved forward, the locking member may efficiently escape from the confining protrusion part due to the lifting guide step provided in the second rack member and the extending step provided in the locking member. In addition, the second rack member may move backward only to a predetermined position due to the stopper member.

Additionally, the holder may be provided to confine the stopper member until the locking member escapes from the confining protrusion part. Furthermore, the holder may be configured to be exposed to an upper part of the second rack member by passing therethrough. Accordingly, the holder may move away from the stopper member at the same time when the second rack member is moved.

In addition, since a distance defined between a rear surface of the first receiving groove and a rear surface of the second receiving groove is longer than a distance defined between a rear surface of the holder and a rear surface of the locking member, the holder and the locking member may be sequentially operated. Additionally, an upper surface of the first rack member may be replaced with the first rack cover.

In addition, the second rack member may properly follow the first rack member due to provision of the linkage part. Furthermore, the stopper member may be configured to move forward and backward in the second rack member so that the extending step of the locking member properly climbs on the lifting guide step. Additionally, the refrigerator may include the confining member such that the first rack member is prevented from unwantedly moving backward. In addition, the confining member may be a coil spring.

Furthermore, a backward moving distance of the second rack member may be confined by the confining hook of the stopper member. Additionally, the second rack cover made of a metal plate is provided and accordingly, twisting or deformation of the second rack member is prevented.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/583,726 filed Sep. 26, 2019, U.S. application Ser. No. 16/582,647 filed Sep. 25, 2019, U.S. application Ser. No. 16/582,518 filed Sep. 25, 2019, U.S. application Ser. No. 16/582,605 filed Sep. 25, 2019, U.S. application Ser. No. 16/582,712 filed Sep. 25, 2019, U.S. application Ser. No. 16/582,810 filed Sep. 25, 2019, U.S. application Ser. No. 16/582,668 filed Sep. 25, 2019, U.S. application Ser. No. 16/582,755 filed Sep. 25, 2019, U.S. application Ser. No. 16/582,831 filed Sep. 25, 2019, U.S. application Ser. No. 16/585,284 filed Sep. 27, 2019, U.S. application Ser. No. 16/585,301 filed Sep. 27, 2019, and U.S. application Ser. No. 16/585,816 filed Sep. 27, 2019, whose entire disclosures are also hereby incorporated by reference.

What is claimed is:

1. A refrigerator comprising:

a cabinet having an opening to access a storage chamber provided within the cabinet;

a drawer including a front panel and a storage bin coupled to a rear of the front panel, the drawer being coupled to the cabinet such that drawer moves between a first position in which the front panel closes the opening of the cabinet and the storage bin is received in the storage chamber, and a second position in which the front panel is spaced away from the opening of the cabinet and at least a portion of the storage bin is positioned outside of the storage chamber;

a pinion positioned at a lower surface of the storage chamber; and a rack gear assembly coupled to the storage bin and including;

a first rack that includes a first rack gear, a second rack that includes a second rack gear, the first rack gear and the second rack engaging the pinion; and a confining module including a latch that couples the second rack to an interior surface of the storage chamber to limit a forward movement of the second rack when the first rack is moved forward by less than a prescribed distance and releases the second rack from the interior surface of the storage chamber when the first rack is moved forward by at least the prescribed distance, wherein a wing end is provided at each of opposite sides of a rear end of the second rack member by protruding to the outside, and a blocking part is provided on a bottom surface of an inner part of the storage chamber to block an upward movement of each of the wing ends.

2. The refrigerator of claim 1, wherein the first rack of the rack gear assembly is fixed to a lower surface of the storage bin, and the second rack of the rack gear assembly to slidably coupled the first rack.

3. The refrigerator of claim 2, wherein the first rack includes:

a movement guiding groove provided in and recess from a lower surface of first rack, the movement guiding groove guiding a sliding movement of the second rack when the second rack is received in the movement guiding groove;

a linkage protrusion provided on a one of the first rack or the second rack; and a linkage step provided on another one of the first rack or the second rack and positioned to collide with the linkage protrusion so that the second rack moves forward in cooperation with the first rack when the first rack is moved forward by at least the prescribed distance.

4. The refrigerator of claim 3, wherein the movement guiding groove is formed through a rear surface of the first rack such that the second rack is exposed to a rear of the movement guiding groove.

5. The refrigerator of claim 3, wherein the first rack gear of the first rack is provided at a side of the movement guiding groove along a moving direction of the first rack and is provided in front of the movement guiding groove, the second rack gear of the second rack is positioned in parallel with the first rack gear of the first rack on a side portion of a lower surface of the second rack and is provided in a moving direction of the second rack, and the pinion has a width corresponding to a combined width of the first rack gear of the first rack and the second rack gear of the second rack.

6. The refrigerator of claim 1, wherein the blocking plate extends between a first end at a position corresponding to a rotational axis of the pinion and a second end that positioned to a rear side of the pinion.

7. The refrigerator of claim 1, wherein the wing end is configured to be gradually inclined upward or rounded backward, and a rear end of the blocking plate is configured to be gradually inclined upward or rounded backward.

8. The refrigerator of claim 3, further comprising:

a confining protrusion provided to extend upward from the lower surface of the storage chamber, and wherein the latch is provided to move vertically in the second rack member, the latch confining a forward movement of the second rack by being positioned to contact a rear of the confining protrusion part the first rack is moved forward by the prescribed distance and releasing the second rack by being moved upward to a position higher than the confining protrusion after the first rack is moved forward by at least the prescribed distance.

9. The refrigerator of claim 8, wherein a through hole is provided at a front end of the second rack, a front to rear length of the through hole being longer than a front to rear length of the latch, lifting guide steps are provided at opposite sides of the through hole in an upper surface of the second rack, the lifting guide step being gradually inclined or round upward toward a rear of the second rack, an upper end of the latch is configured to pass through the through hole of the second rack, and an extending step is provided at an upper end of the latch by extending to opposite sides thereof such that the extending step engages the lifting guide steps.

10. The refrigerator of claim 9, wherein the confining module further includes a stopper frame having a confining hook protruding downward from stopper frame, the confining hook preventing an additional movement of the second rack by contacting a front surface of the confining protrusion when the second rack is moved backward to a prescribed position, and wherein the latch is positioned to vertically pass through a rear end of the stopper frame.

11. The refrigerator of claim 10, further comprising:

a holder groove provided on an upper surface of a front of the stopper frame to be gradually inclined downward backward, and a holder provided in the second rack, a portion of the holder being received in the holder groove of the stopper frame, the holder being position to limit a motion the stopper frame until the first rack is moved forward by the prescribed distance and moving away from the stopper frame while moving together with the first rack when the first rack is moved forward by the prescribed distance.

12. The refrigerator of claim 11, wherein the holder is configured to be exposed to an upper part of the second rack by passing therethrough, and a first receiving groove in which an upper end of the holder is received and a second receiving groove in which the upper end of the latch is received are sequentially provided along a moving direction of the first rack on the upper surface of the first rack.

13. The refrigerator of claim 12, wherein a distance between a rear surface of the first receiving groove and a rear surface of the second receiving groove is greater than a distance defined between a rear surface of the holder and a rear surface of the latch.

14. The refrigerator of claim 12, further comprising:

a first rack cover provided on an upper surface of the first rack to cover an open upper portion of the movement guiding groove, wherein the first receiving groove and the second receiving groove are provided on a lower surface of the first rack cover.

15. The refrigerator of claim 14, wherein:

the linkage protrusion is provided on a lower surface of a rear side of the first rack cover; and the linkage step provided on an upper surface of a second rack cover and positioned to collide with the linkage protrusion so that first rack and the second rack move in unison.

16. The refrigerator of claim 10, wherein a motion groove is provided on a lower surface of the second rack, a front to rear length of the motion groove being greater than a front to rear length of the stopper frame, and the stopper frame is positioned to move forward and backward in the motion groove, wherein a spring is positioned between a wall surface of the stopper frame and the motion groove to confine a position of the stopper frame by providing a compression force so that the extending step of the latch is held on the lifting guide step when the second rack is moving together with the first rack.

17. The refrigerator of claim 16, wherein a first end of the spring is connected to the stopper frame and a second end of the spring is connected to the second rack.

18. The refrigerator of claim 10, further comprising:

a second rack cover covering the lower surface of the second rack, wherein a stopper exposure hole is provided at a front end portion of the second rack cover to allow a portion of the stopper frame to be exposed therethrough, and the confining hook of the stopper frame protrudes downward through the stopper exposure hole.

19. The refrigerator of claim 18, wherein the second rack cover is formed of metal and includes:

a planar surface provide over a lower surface of the second rack, and walls that extend opposite side edges and a rear edge of the planar surface so as to cover, opposite side surfaces, and a rear surface of the second rack.

* * * * *